US007788765B2

(12) United States Patent
Allen

(10) Patent No.: US 7,788,765 B2
(45) Date of Patent: Sep. 7, 2010

(54) AIR RECIRCULATING SURFACE CLEANING DEVICE

(76) Inventor: Donavan J. Allen, 3433 Cannon Rd., Greer, SC (US) 29651

( * ) Notice: Subject to any disclaimer, the term of this patent is extended or adjusted under 35 U.S.C. 154(b) by 98 days.

(21) Appl. No.: 11/849,012

(22) Filed: Aug. 31, 2007

(65) Prior Publication Data

US 2008/0209667 A1 Sep. 4, 2008

Related U.S. Application Data

(63) Continuation of application No. 10/706,604, filed on Nov. 12, 2003, now abandoned, which is a continuation-in-part of application No. 10/647,792, filed on Aug. 25, 2003, now abandoned.

(51) Int. Cl.
*A47L 5/14* (2006.01)

(52) U.S. Cl. ..... 15/345; 15/346

(58) Field of Classification Search ..... 15/345, 15/346; *A47L 5/14*

See application file for complete search history.

(56) References Cited

U.S. PATENT DOCUMENTS

| | | | |
|---|---|---|---|
| 784,801 | A | 3/1905 | Moorhead |
| 1,383,455 | A | 7/1921 | Farnsworth |
| 1,611,786 | A | 12/1926 | Serva |
| 1,654,727 | A | 1/1928 | Green et al. |
| 1,668,036 | A | 5/1928 | Aalborg |
| 2,012,640 | A | 8/1935 | Shipman |
| 2,018,791 | A | 10/1935 | Kern |
| 3,048,876 | A | 8/1962 | Kemnitz |
| 3,268,942 | A | 8/1966 | Rossnan |
| 3,495,932 | A | 2/1970 | Tuma |
| 3,694,848 | A | 10/1972 | Alcala |
| 3,774,262 | A | 11/1973 | Anthony et al. |
| 3,964,925 | A | 6/1976 | Burgoon |
| 4,373,228 | A | 2/1983 | Dyson |
| 4,447,930 | A | 5/1984 | Glenn, III et al. |

(Continued)

FOREIGN PATENT DOCUMENTS

| | | |
|---|---|---|
| GB | 2138280 | 10/1984 |

(Continued)

OTHER PUBLICATIONS

Office Action for U.S. Appl. No. 10/647,792 mailed on Feb. 28, 2006.

*Primary Examiner*—David A Redding
(74) *Attorney, Agent, or Firm*—Margaret Polson; Oppedahl Patent Law Firm LLC

(57) ABSTRACT

A fluid recirculating cleaning device includes an exhaust port defining an exhaust port longitudinal axis, a fluid source end and an exhaust end defining a first cross-sectional area. A suction port includes a suction port longitudinal axis, a fluid exit end and a fluid entrance end defining a second cross-sectional area greater than the first cross-sectional area. The suction port includes a second outer surface that extends from the entrance end toward the fluid exit end. A vacuum blower motor sucks fluid in through the suction port to create fluid flow away from the vacuum motor and toward the exhaust port exhaust end. The exhaust port exhaust end is recessed from the suction port fluid entrance end and the two ports are located with respect to one another so that fluid flow from the exhaust port will be effectively drawn into the suction port.

14 Claims, 20 Drawing Sheets

U.S. PATENT DOCUMENTS

| | | | | |
|---|---|---|---|---|
| 4,884,315 | A | 12/1989 | Ehnert | |
| 5,189,757 | A | 3/1993 | Williams et al. | |
| 5,280,667 | A | 1/1994 | Coathupe | |
| 5,289,610 | A | 3/1994 | Monson | |
| RE35,033 | E | 9/1995 | Waldhauser | |
| 5,450,649 | A * | 9/1995 | Turnbull | 15/330 |
| 5,457,848 | A | 10/1995 | Miwa | |
| 5,477,585 | A | 12/1995 | Hentzschel et al. | |
| 5,542,148 | A | 8/1996 | Young | |
| 5,647,092 | A | 7/1997 | Miwa | |
| 5,901,411 | A | 5/1999 | Hato et al. | |
| 6,052,861 | A | 4/2000 | Keller | |
| 6,237,188 | B1 * | 5/2001 | Takemoto et al. | 15/346 |
| 6,245,159 | B1 | 6/2001 | Deng | |
| 6,725,500 | B2 | 4/2004 | Allen et al. | |
| 6,957,472 | B2 * | 10/2005 | Illingworth et al. | 15/345 |
| 2002/0020035 | A1 | 2/2002 | Illingworth | |
| 2004/0134024 | A1 | 7/2004 | Allen | |
| 2005/0217065 | A1 | 10/2005 | Allen | |

FOREIGN PATENT DOCUMENTS

| | | |
|---|---|---|
| JP | S48-101765 | 12/1973 |
| JP | S60-188553 | 9/1985 |
| JP | H03-162814 | 7/1991 |
| JP | H03-162817 | 7/1991 |

* cited by examiner

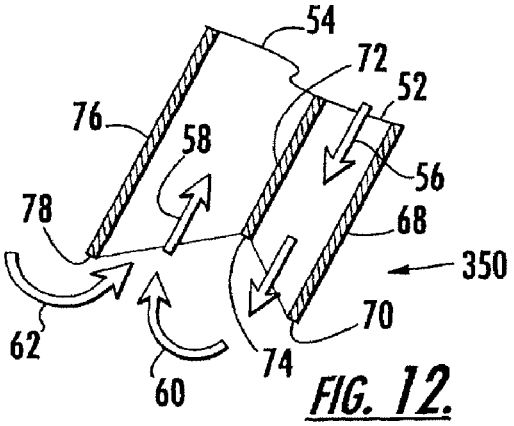
FIG. 12.
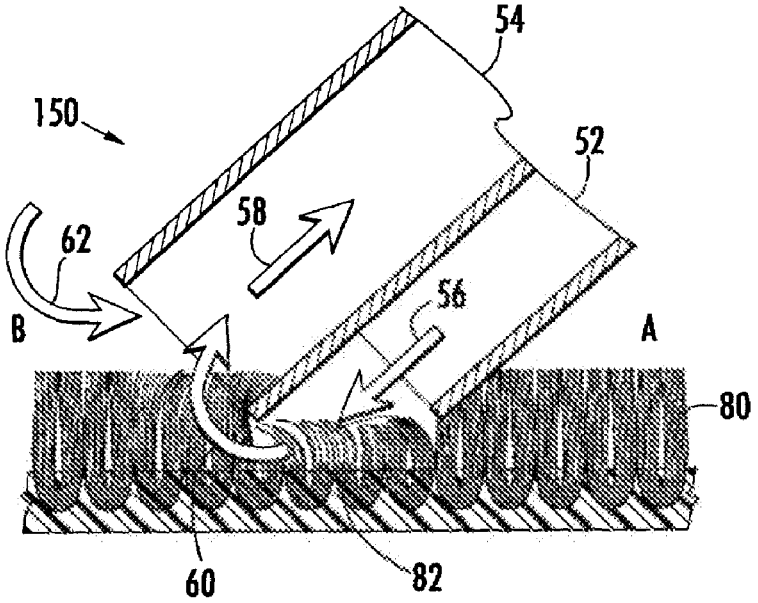
FIG. 13.
FIG. 14.
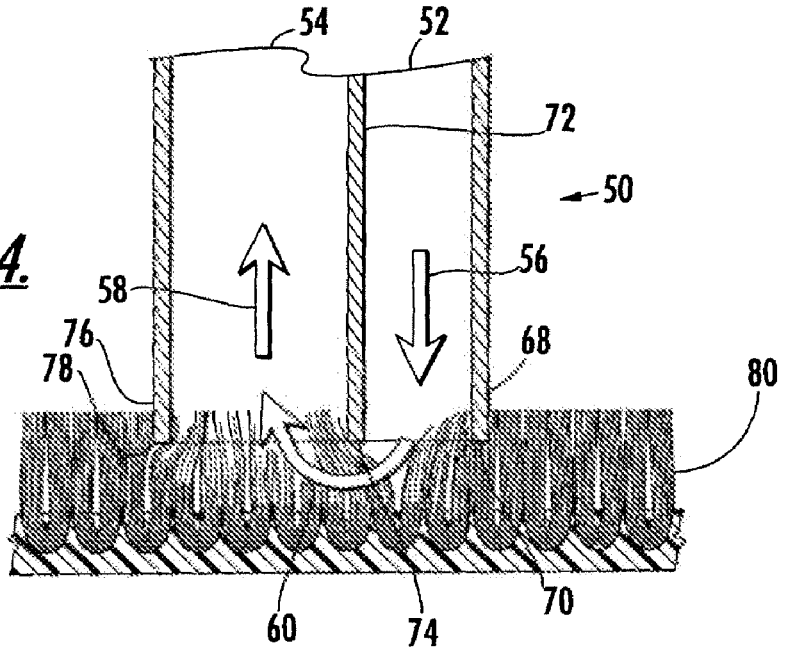

AIR RECIRCULATING SURFACE CLEANING DEVICE

CROSS REFERENCE TO RELATED APPLICATIONS

This application is a continuation of application Ser. No. 10/706,604 filed Nov. 12, 2003, now abandoned, which is a continuation in part of application Ser. No. 10/647,792 filed Aug. 25, 2003, now abandoned, both of which are hereby incorporated by reference.

BACKGROUND OF THE INVENTION

The present invention relates generally to air recirculating type surface cleaning devices, in which the recirculated air flow may be used to remove debris and/or moisture from the cleaning surface.

It is known to provide a recirculating type floor cleaning or drying apparatus in which at least some of the exhaust air stream is recirculated through a suction air stream. In U.S. Pat. No. 3,964,925, to Burgoon, an apparatus for cleaning carpets is disclosed having an exhaust air nozzle located near the vacuum nozzle. The device disclosed in Burgoon utilizes the heated exhaust air (from the vacuum motor) to aid in drying floor coverings. The exhaust air nozzle or opening of Burgoon, if provided, includes a moveable rear wall that pivots about a hinge. Burgoon also states that "the exhaust air nozzle can be eliminated."

In U.S. Pat. No. 4,884,315, to Ehnert, a closed circuit vacuum apparatus having an air recirculation duct is disclosed. Ehnert discloses a device in which the recirculation air passes through the carpet to provide a pneumatic agitation process.

In U.S. Pat. No. 5,457,848, to Miwa, a recirculating type cleaner is disclosed having a dust collecting port including a suction port and an outlet in which downstream flow of a fan is recirculated, discharged through the outlet, and drawn into the suction port. Several devices said to be prior art are also discussed in Miwa. FIGS. 1A and 1B of the Miwa patent show a rotary brush and a rotating vibrator device, respectively, in the exhaust stream adjacent to the suction line. Miwa FIG. 1E shows an exhaust line adjacent to a much larger suction area. Miwa FIGS. 1C and 1D disclose a suction compartment surrounded on at least two sides by exhaust lines, where the exhaust is discharged at an angle in Miwa FIG. 1C. Miwa FIGS. 2B and 2C disclose prior art recirculating type cleaners with valves for diverting a portion of the air flow so that the recirculation may be less than 100%. FIGS. 3A and 3B of Miwa show a recirculating type cleaner having a central jet nozzle terminating at an outlet for discharging recirculating flow. A dust collecting head includes a suction port that surrounds the nozzle outlet.

In U.S. Pat. No. 5,392,492, to Fassauer, an air-floated vacuum cleaner is disclosed that includes an impeller and an agitator below the impeller. Air to lift this device is provided through a plurality of air inlet openings and discharged under pressure by a second air impeller and eventually to the surface of the floor.

In U.S. Pat. No. 3,268,942, to Rossnan, a suction cleaning nozzle is disclosed that utilizes the exhaust air from the machine discharged through a plurality of finger-like air directing tubes to comb and set up the carpet so that the suction action can remove the dust and dirt from the pile and the base of the floor covering.

In U.S. Pat. No. 5,553,347, to Inoue, et al., an upright floating vacuum cleaner is disclosed having a central exhaust surrounded by a suction air inlet port.

Although it's known to utilize exhaust air to assist in drying and debris removal from floor coverings in a recirculating cleaner, there exists a need for an air recirculating type cleaning device that utilizes the collective energy of both the exhaust and suction lines to obtain superior results in less time and that conserves energy resources in the process.

SUMMARY OF INVENTION

The present invention recognizes and addresses the foregoing considerations, and others, of prior art constructions and methods. Accordingly, it is an aspect of the present invention to provide a novel cleaning and drying device.

It is also an aspect of the present invention to utilize the combined energy in the exhaust line and the suction line of a recirculating type vacuum cleaner to significantly increase the suction in the suction line and the air flow across the cleaning surface and into the suction port.

Another aspect of the present invention is to increase the suction power of a recirculating type vacuum unit without increasing energy use from the vacuum motor.

Another aspect of the present invention is to provide a vacuum cleaning unit that provides increased suction without the vacuum nozzle and housing being sucked downward toward the cleaning surface, permitting an operator to move the vacuum unit across the cleaning surface with less effort via a gliding effect.

Another aspect of the present invention is to provide a vacuum unit that can vacuum dust, debris, and moisture from clothes, curtains and other structurally movable surfaces without sucking the material to be cleaned into the vacuum unit.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Some of these aspects are achieved by providing a fluid recirculating cleaning device having an exhaust port defining an exhaust port longitudinal axis. The exhaust port has a fluid source end and an exhaust end defining a first cross-sectional area. A suction port includes a suction port longitudinal axis, a fluid exit end and a fluid entrance end defining a second cross-sectional area that is greater than the first cross-sectional area. The suction port defines a second outer surface that extends from the entrance end toward the fluid exit end. A vacuum blower motor is disposed between the exhaust and suction ports for creating fluid flow away from the vacuum motor and toward the exhaust port exhaust end. The vacuum blower sucks fluid in through the suction port fluid entrance end. The exhaust port exhaust end is recessed from the suction port fluid entrance end, and the exhaust and suction ports are located with respect to one another so that fluid flow from the exhaust port will be effectively drawn into the suction port.

In one embodiment, the exhaust port and the suction port are dimensioned and configured so that the fluid flow out of the exhaust port creates a low pressure zone immediately in front of the suction port fluid entrance end. In some embodiments, the exhaust port and the suction port are dimensioned and configured so that the suction power in the suction port is at least two times what it would be when the exhaust and suction ports are separated.

In one embodiment, the suction port second outer surface includes an inner panel disposed adjacent the exhaust port exhaust end and an outer panel disposed opposite the exhaust port. In one embodiment, the suction port inner panel and the suction port outer panel are generally parallel. In some embodiments, the suction port inner panel and the suction port outer panel are generally parallel, and the suction port longitudinal axis is generally parallel to the suction port inner panel and the suction port outer panel. In some embodiments, the exhaust port first outer surface includes an inner panel disposed adjacent to the suction port inner panel and an outer panel disposed opposite the suction port inner panel.

In one embodiment, a first portion of the exhaust port inner panel forms a portion of the exhaust port exhaust end and the first portion is in contact with the suction port inner panel. In one embodiment, the exhaust port inner panel and the exhaust port outer panel are generally parallel and the exhaust port longitudinal axis is generally parallel to the exhaust port inner panel and the exhaust port outer panel.

In one embodiment, fluid is sucked into the suction inlet in a first direction and the exhaust outlet is disposed radially within the suction inlet. The exhaust outlet exhausts fluid in a second direction that is generally parallel to and opposite the first direction. In another embodiment, the suction inlet is disposed radially within the exhaust outlet and the suction inlet sucks air into the suction inlet fluid entrance end in a first direction and the exhaust outlet exhausts fluid in a second direction that is angled with respect to the first direction.

In another embodiment, the suction inlet and the exhaust outlet are dimensioned and configured so that the fluid flow out of the exhaust outlet creates a low pressure zone immediately in front of the suction inlet fluid entrance end to significantly increase the overall suction power of the fluid recirculating cleaning device.

In one embodiment, the suction inlet defines a generally circular shape at the fluid entrance end. The suction inlet may include an outer surface outer panel that at least partially defines the exhaust outlet inner panel, and the suction inlet outer panel and the exhaust outlet inner panel may be parallel with respect to each other.

Still further aspects of the present invention are achieved by an air recirculating cleaning device having an exhaust port defining an exhaust end and a fluid source end. The exhaust port exhaust end defines a first cross-sectional area. A suction port has a fluid entrance end and a fluid exit end, the suction port fluid entrance end defining a second cross-sectional area at the fluid entrance end that is greater than the first cross-sectional area. A vacuum blower motor is disposed between the exhaust and suction ports for creating air flow away from the vacuum blower toward the exhaust end. The vacuum blower sucks air in through the suction port air entrance. The suction port fluid entrance end and the exhaust port exhaust end are correspondingly shaped, and the exhaust port and the suction port are located with respect to one another so that fluid flow from the exhaust port will be effectively drawn into the suction port.

In one embodiment, a roller brush is disposed for rotation about an axis between the left side central panel and the right side central panel. In one embodiment, the suction port includes a first suction port and a second suction port, and the cleaning device includes at least one movable valve disposed in at least one of the first suction port and the second suction port and is configured to permit the valve to at least partially block flow between at least one of the first suction port and the second suction port and the vacuum blower motor.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 12 is an enlarged diagrammatic sectional view of a recirculating vacuum nozzle in accordance with an embodiment of the present invention;

FIG. 13 shows the vacuum nozzle of FIG. 10 in use with a carpeted surface;

FIG. 14 shows the vacuum nozzle of FIG. 9 in use with a carpeted surface;

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
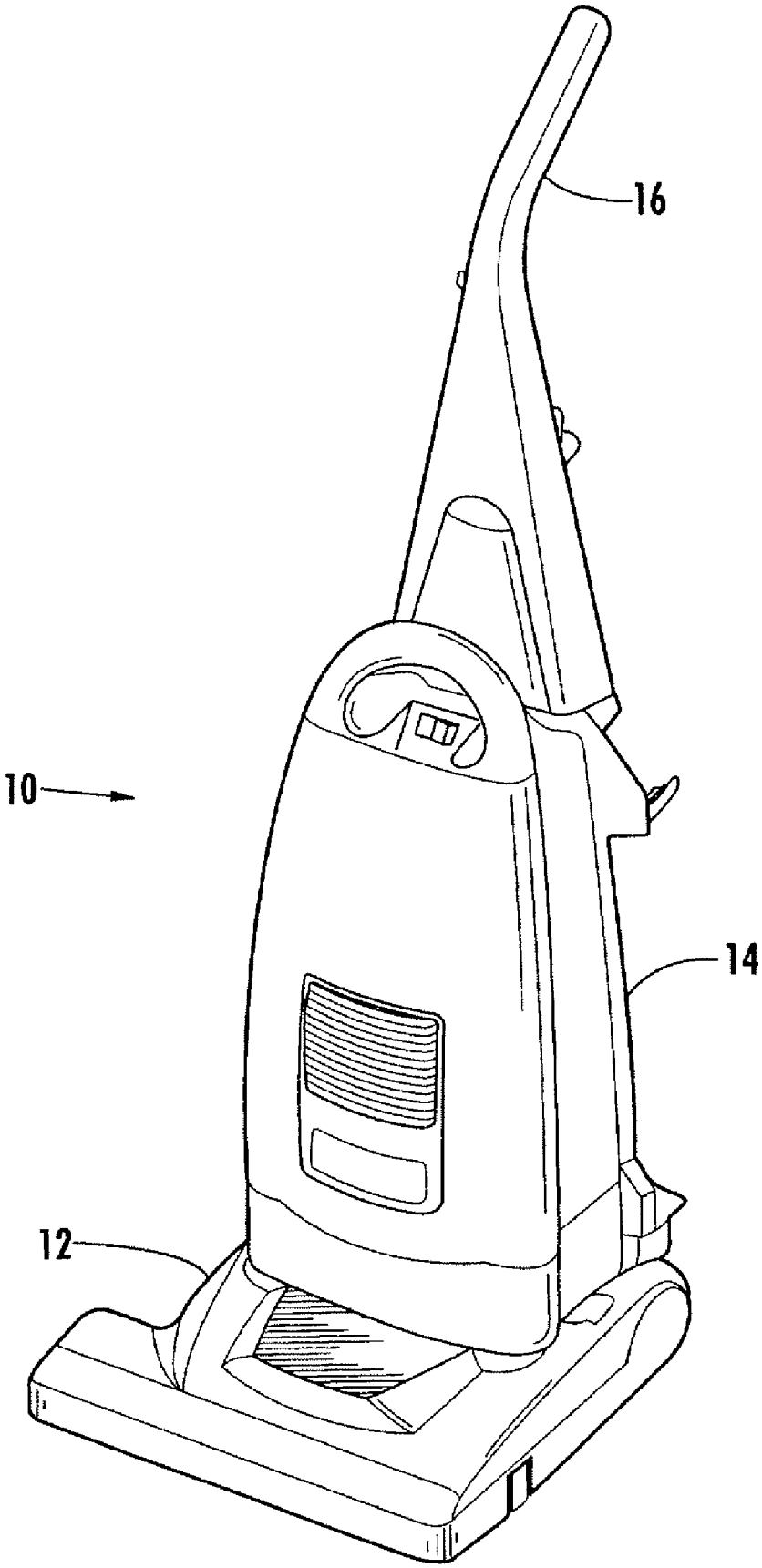
FIG. 1 is a perspective view of a recirculating vacuum cleaner in accordance with an embodiment of the present invention.

Referring to FIG. 1, an upright recirculating floor cleaner or vacuum unit 10 is illustrated. Vacuum unit 10 includes a base portion 12, an upright section 14, and a handle 16.

Figure 2:
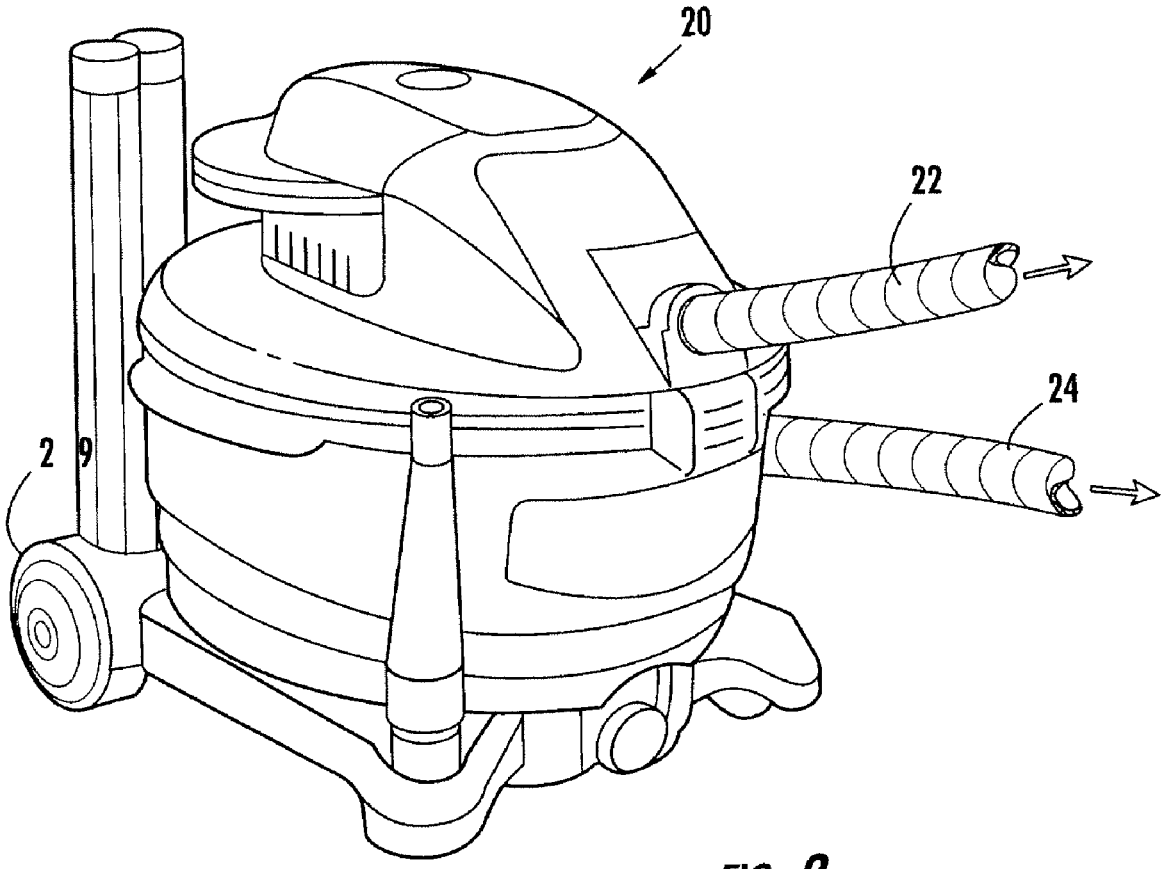
FIG. 2 is a partial perspective view of an alternative recirculating vacuum cleaner in accordance with an embodiment of the present invention.

FIG. 2 illustrates another air recirculating floor cleaning or vacuum unit 20. Vacuum unit 20 includes a suction hose 22, an exhaust hose 24, and wheels 29. As should be understood, a motor is contained within cleaning unit 20 and provides power to the suction and exhaust hoses.

Figure 3:
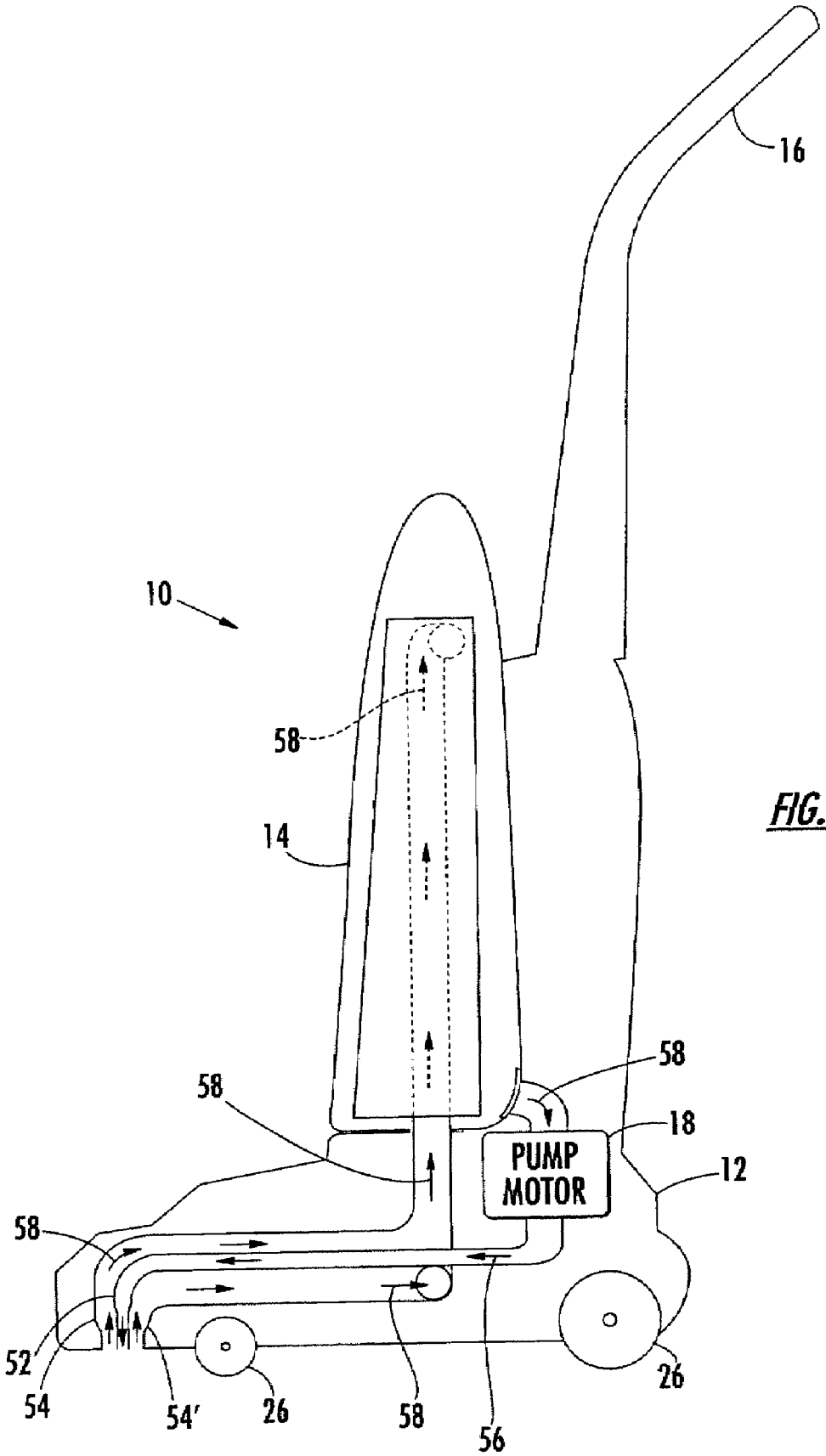
FIG. 3 is a diagrammatic view showing operation of the recirculating vacuum cleaner of FIG. 1.

FIG. 3 illustrates vacuum unit 10 showing wheels 26. In this embodiment, an exhaust line 53 extending from an exhaust port 52 discharges air in the direction shown by arrows 56. Two suction ports 54 and 54' respectively located in front of and behind exhaust port 52 suck air up into suction lines 55 and 55' in the direction shown by arrows 58. Suction line 55' merges with suction line 55 to form one line that leads from base 12 into upright portion 14 where the suction air passes through a filter to remove debris and/or moisture. Once filtered, the suction air recirculates through a pump motor 18 and is blown out into exhaust line 53, thus repeating the recirculation process.

Figure 4:
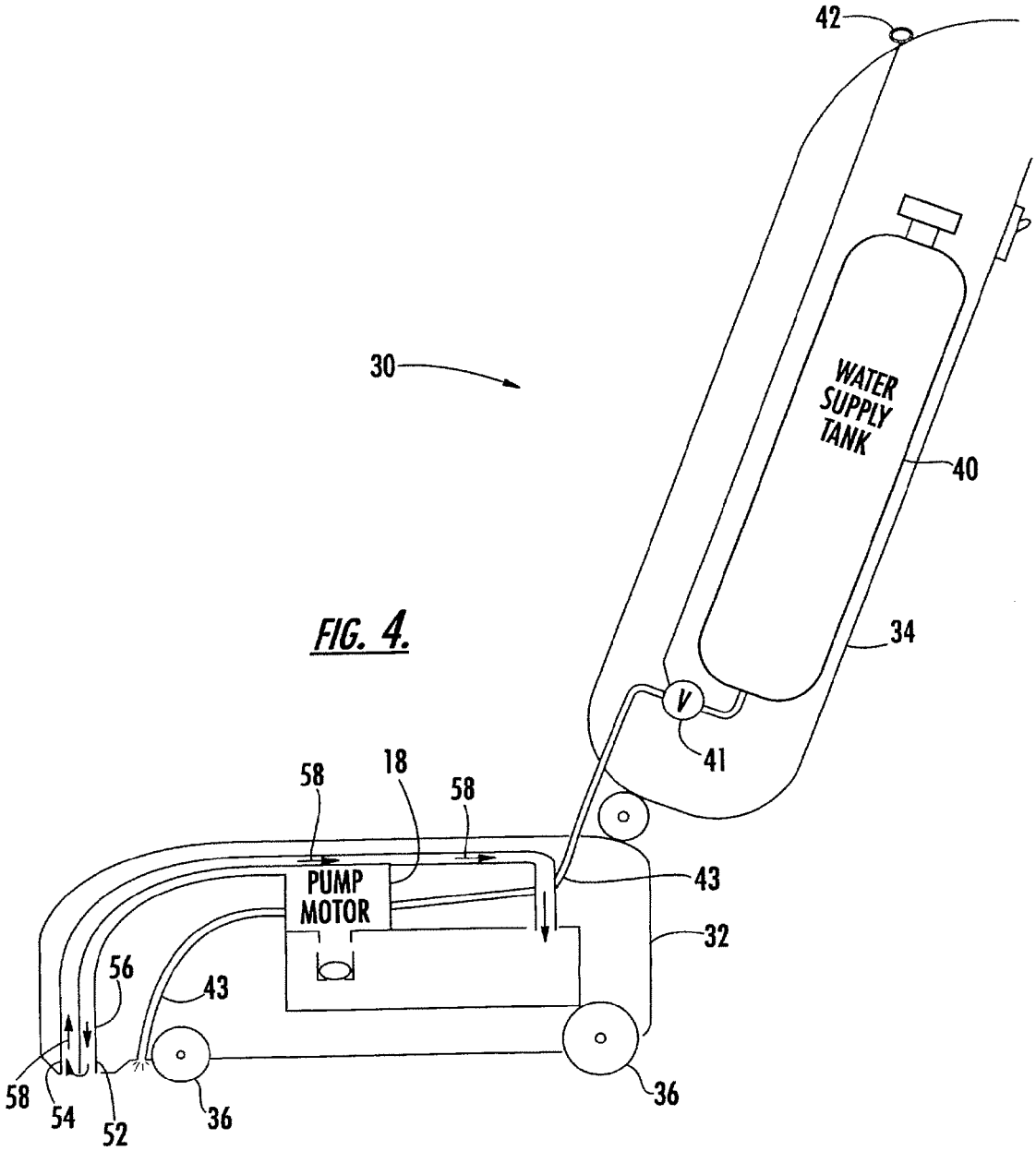
FIG. 4 is a diagrammatic view showing operation of a recirculating vacuum cleaner having a fluid supply tank in accordance with an embodiment of the present invention.

As shown in FIG. 4, the present invention can be utilized with (and in fact enhances the performance of) a fluid cleaning solution or water. A floor cleaning unit 30 includes a base 32, an upright housing portion 34, wheels 36, a fluid supply tank 40, and pump motor 18. The contents of tank 40 may be discharged through fluid line 43 onto the cleaning surface, and discharge of tank 40 may be controlled by a valve 41 operated by an actuation trigger or lever 42.

It should be understood that many, if not all of the various embodiments illustrated and described herein could be utilized with vacuum unit 10 with only minor modifications. For example, suction line 55' of FIG. 3 could be eliminated as is shown and described below with reference to FIGS. 9, 10 and 12.

Figure 5:
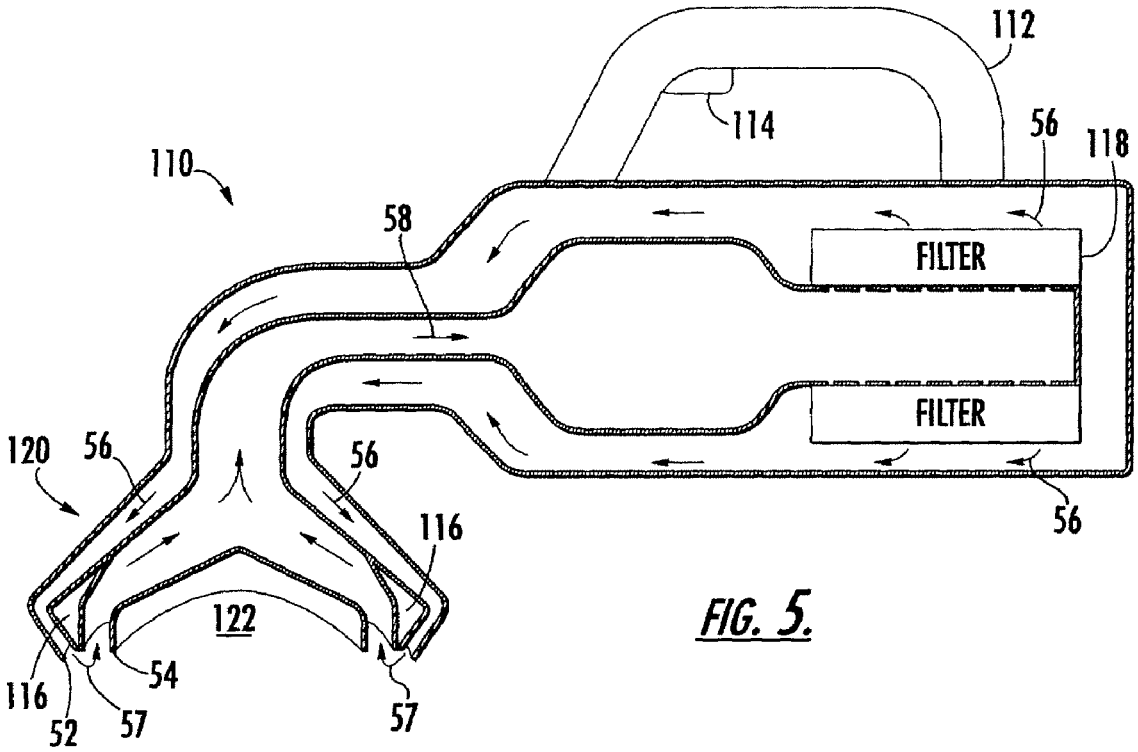
FIG. 5 is a diagrammatic sectional view of a hand held recirculating vacuum cleaner in accordance with an embodiment of the present invention.

FIG. 5 illustrates a hand held recirculating type cleaning unit 110. Cleaning unit 110 includes a handle 112, a power switch 114, and a vacuum nozzle 120. Vacuum nozzle 120 includes exhaust port 52 and suction port 54, which may be shaped in a circular, elliptical, or other configuration. A central void or space 122 is defined inward of suction port 54. Cleaning unit 110 is powered by a motor and the recirculating air stream passes through a filter 118. Exhaust air is shown by arrows 56 and suction air by arrows 58. Arrows 57 show that exhaust air is immediately suctioned up into suction ports 54, utilizing both the energy of the exhaust and suction lines together to clean a surface area. In this case, exhaust port 52 is angled with respect to suction port 54. This angled configuration may be produced at least in part by a void space 116 defined between the two ports. In one embodiment the angle between the two ports is approximately 35 degrees, the exhaust port defines a width of approximately one-quarter of an inch (0.25 inches), and the suction port is approximately one-half inch wide (0.5 inches).

By placing exhaust port 52 adjacent to suction port 54 and by controlling both the size of and relative distances between the exhaust and suction ports, the present invention produces a significantly enhanced suction force in a recirculating vacuum device. However, it should be distinctly understood that numerous configurations (including varying widths, angles, and other criteria related to the suction and exhaust ports) may be utilized in a vacuum nozzle within the scope and spirit of the present invention. For example, the "concept" (discussed below) of the present invention has been observed in a generally rectangularly shaped port nozzle, at an exhaust width of one-eighth of an inch (0.125 inches) and a suction width of one-quarter of an inch (0.25 inches), and at an exhaust width of one-quarter of an inch (0.25 inches) and a suction width of one-half inch (0.50 inches). Of course, these dimensions do not represent the maximum and minimum widths as other design dimensions could be modified. For example, the angle between the suction and exhaust lines, the distance to the cleaning surface, the power delivered by the vacuum motor, and other design parameters could be modified.

The effect produced by the present invention is hereafter referred to as the "concept." In testing with generally rectangular shaped and separate suction and exhaust lines, one can see and hear the concept initiate as the exhaust and suction lines become properly oriented. Once the concept initiates, the overall vacuum force produced is so strong that even surrounding air, debris, and/or moisture is often sucked into the suction line (as described and illustrated below). In many embodiments of the present invention, the concept initiates when holding the device in the open air. In contrast, when the exhaust air stream is directed at a floor or another cleaning surface, the concept is even more likely to either be initiated or maintained as the exhaust air is "reflected" off of the floor and toward the suction line.

Figure 29:
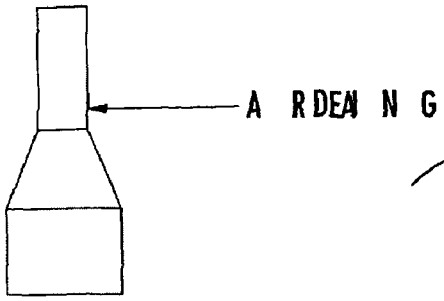
FIG. 29 is a diagrammatic view of a suction port of a vacuum nozzle used in manometer testing of the present invention.

For example, with reference to FIG. 29, which illustrates the two locations A and B within a suction port used to collect test data using a manometer and with the assistance of Clemson University, one can see that the suction produced at various points within the suction line is significantly greater "with [the] concept" in effect. An exhaust is not shown in FIG. 29, however, it should be understood that an exhaust line was disposed adjacent to the suction line to produce the concept of the present invention in conducting this testing.

Table 1 below presents the results of an "initial" manometer test and a "recheck" test conducted on the same day with the results shown in inches of water.

TABLE 1

Manometer Test Readings in Inches of water

| | Location | Read-1 | Read-2 | Total |
|---|---|---|---|---|
| Initial Test | | | | |
| Concept | A | 4.7 | 10.9 | 15.6 |
| non-Concept | A | 1.1 | 5.3 | 6.4 |
| Concept | B | 3.0 | 9.2 | 12.2 |
| non-Concept | B | 1.5 | 4.7 | 6.2 |
| Recheck Test | | | | |
| Concept | A | 4.5 | 10.6 | 15.1 |
| non-Concept | A | 1.5 | 4.7 | 6.3 |
| Concept | B | 4.2 | 10.3 | 14.5 |
| non-Concept | B | 1.7 | 4.5 | 6.3 |

This manometer testing shows the loss of air pressure when the "concept" of the present invention is in effect, thus indicating increased air velocity in the suction nozzle as well as the increased suction in the vacuum unit.

Figure 38:
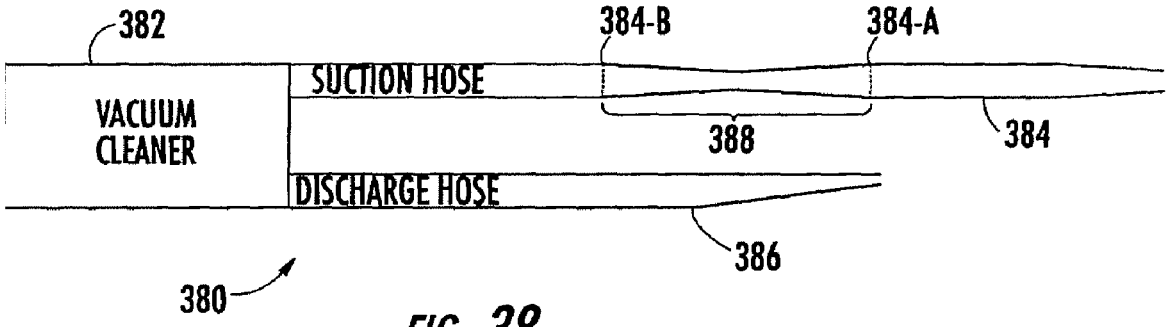
FIG. 38 is a diagrammatic view of a recirculating type vacuum cleaning device showing the testing points utilized in Venturi meter testing to determine the increased suction capability of the present invention.

The concept is further explained below with reference to FIGS. 30-34, and also by FIG. 38 and the Venturi meter test data presented below.

A second test utilizing a Venturi meter further indicates the effect of the "concept" of the present invention. Referring now to FIG. 38, a recirculating type vacuum unit 380 includes a vacuum motor 382, a suction nozzle 384 and an exhaust nozzle 386. In this second type of testing, a Venturi meter 388 was disposed in suction nozzle 384 to measure the change in pressure between points 384-A and 384-B of suction nozzle 384. In conducting this testing, a U-shaped manometer having two ends was connected to at points 384-A and 384-B of suction nozzle 384. In an initial test conducted with suction nozzle 384 and exhaust nozzle 386 separated, the Venturi meter indicated a change in pressure between points 384-A and 384-B of approximately five and one-quarter inches of water (5.25 inches of water). In a subsequent test conducted with suction nozzle 384 and exhaust nozzle 386 aligned to produce a maximum vacuum cleaner effect ("concept" in effect), the Venturi meter indicated a change in pressure between points 384-A and 384-B of approximately 3.82 inches of water.

This decreased change in pressure between points 384-A and 384-B when the "concept" of the present invention was in effect shows that the fluid flow rate through suction nozzle 384 was optimized and streamlined. This testing was conducted under the assistance of a Professional Engineer and retired Professor of Engineering at Clemson University.

Figure 30:
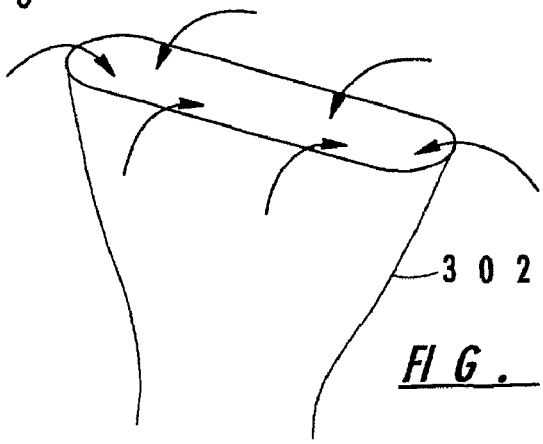
FIG. 30 illustrates a perspective view of a solitary suction nozzle and air-flow into the same.
Figure 31:
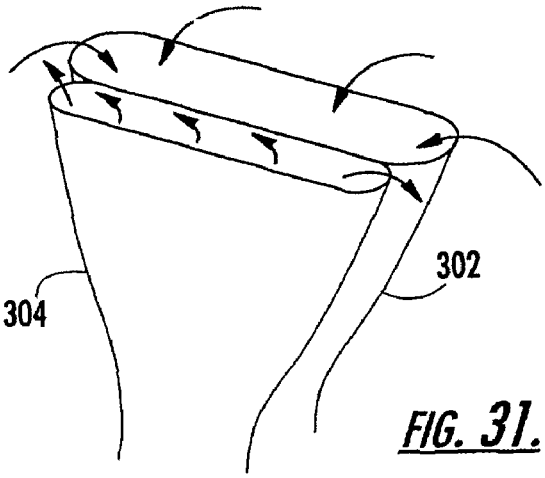
FIG. 31 illustrates a perspective view of a suction nozzle and an exhaust nozzle adjacent to each other and air-flow into and out of each nozzle when the nozzle ends are even with each other.
Figure 32:
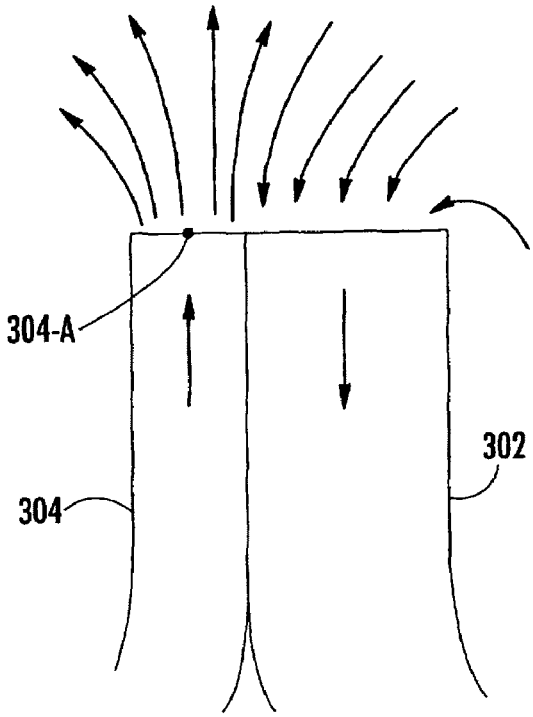
FIG. 32 is a plan view of the nozzles of FIG. 31 showing air-flow into and out of each nozzle.
Figure 33:
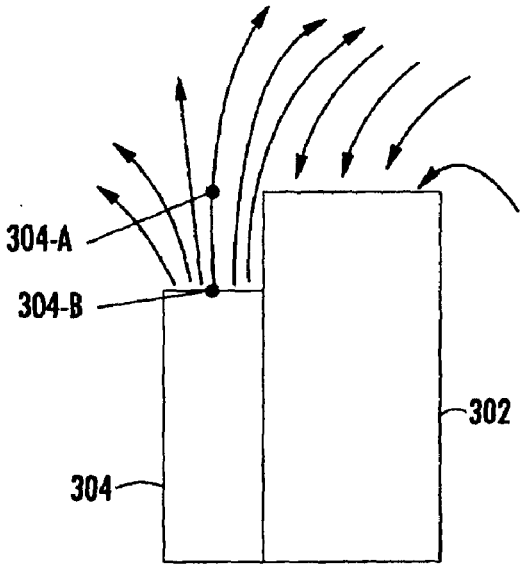
FIG. 33 is a side view of the nozzles of FIG. 31 showing the changing air flow out of the exhaust nozzle and into the suction nozzle as the exhaust nozzle is moved rearward with respect to the suction nozzle.
Figure 34:
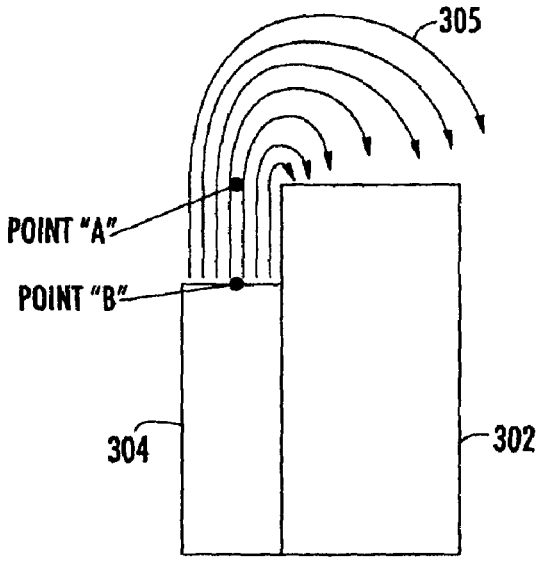
FIG. 34 is a side view of the nozzles of FIG. 31 showing the changing air flow out of the exhaust nozzle and into the suction nozzle as the exhaust nozzle is moved rearward with respect to the suction nozzle at the critical point where the novel vacuum concepts of the present invention are initiated.

The vacuum "concept" of the present invention is further explained with reference to FIGS. 30-34. As shown in FIG. 30, a suction nozzle 302 will typically draw in air from all directions when it is free of obstructions. As shown in FIGS. 31 and 32, when an exhaust nozzle 304 is aligned parallel or at an angle in relation to suction nozzle 302 and the ends of each nozzle are even with respect to each other, the air velocity of the exhaust air at, for example point 304-A, is typically too great for the exhaust air to be drawn immediately into the suction nozzle. However, as exhaust nozzle 304 is drawn rearward (as progressively illustrated in FIGS. 32-34) so that it is recessed from the end of suction nozzle 302, exhaust air from exhaust nozzle 304 reaches a critical point where the air velocity (kinetic energy) has lessened at a point 304-A so that the exhaust air stream can now be drawn immediately toward and into suction nozzle 302 (FIGS. 33 and 34). This effect is known as the concept of the present invention. Once the concept is initiated, the velocity of the fluid flow (of air in the embodiments shown) and the suction capability will increase up to 100% in the area immediately in front of the exhaust and suction nozzles. With the concept initiated, most of the air flow from exhaust nozzle 304 will be drawn toward and into suction nozzle 302, however, as shown by an arrow 305 in FIG. 34, some of the exhausted air may pass over suction nozzle 302 and could block the suction nozzle from drawing air in from this outer side. The amount, if any, of the exhausted air that will pass over the suction nozzle is dependent upon many factors, including the particular configuration of the exhaust and suction nozzles and their proximity to a reflecting surface, for example a carpeted surface. In some embodiments, the suction nozzle appears to draw air in from all directions even absent a contributing factor such a reflecting surface.

Figure 6:
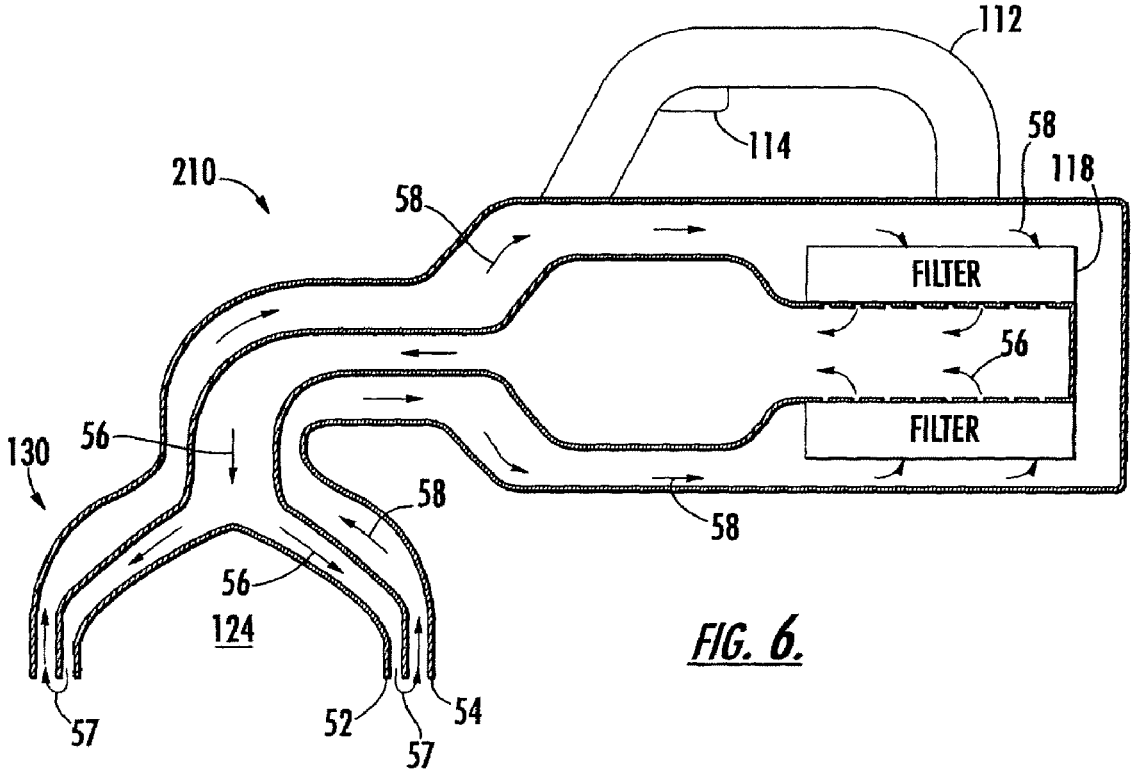
FIG. 6 is a diagrammatic sectional view of a hand held recirculating vacuum cleaner in accordance with an embodiment of the present invention.

FIG. 6 illustrates another hand held recirculating type cleaner 210. Cleaning unit 210 includes handle 112, power control trigger 114, a vacuum nozzle 130, filter 118, and a motor. Vacuum nozzle 130 includes exhaust port 52, suction port 54, which (like nozzle 120) may be shaped in a variety of configurations. A central void or space 124 is defined inward of exhaust port 52. Arrows 57 show that exhaust air is immediately sucked up into the suction line with an enhanced vacuum force as explained above.

Figure 7:
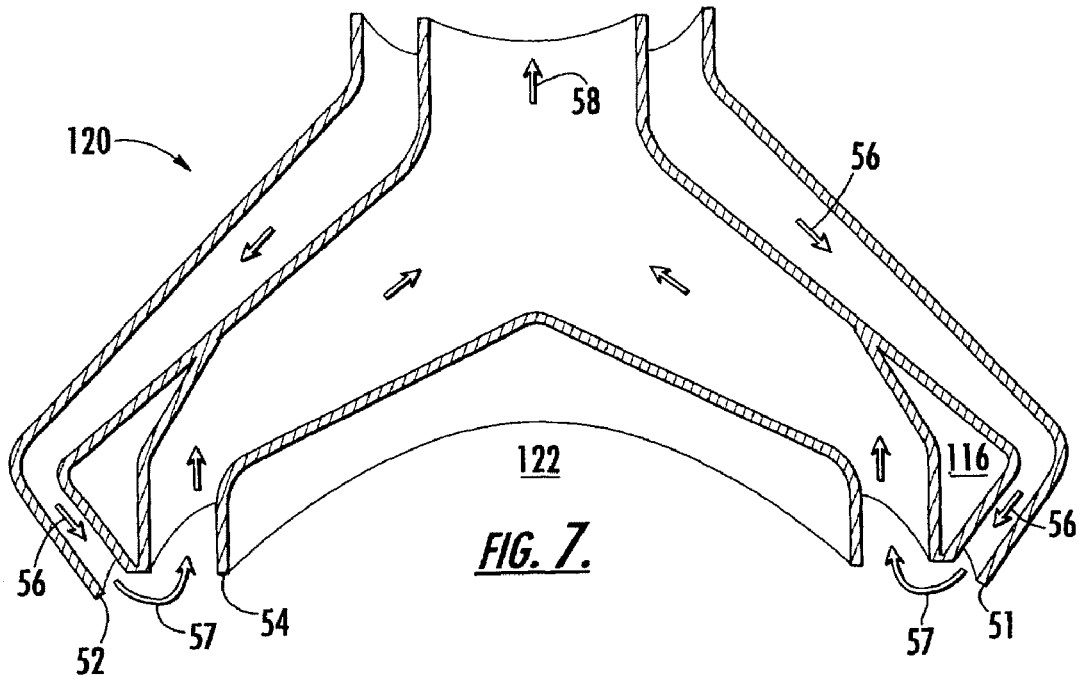
FIG. 7 is an enlarged view of the recirculating vacuum cleaning nozzle of FIG. 5.
Figure 8:
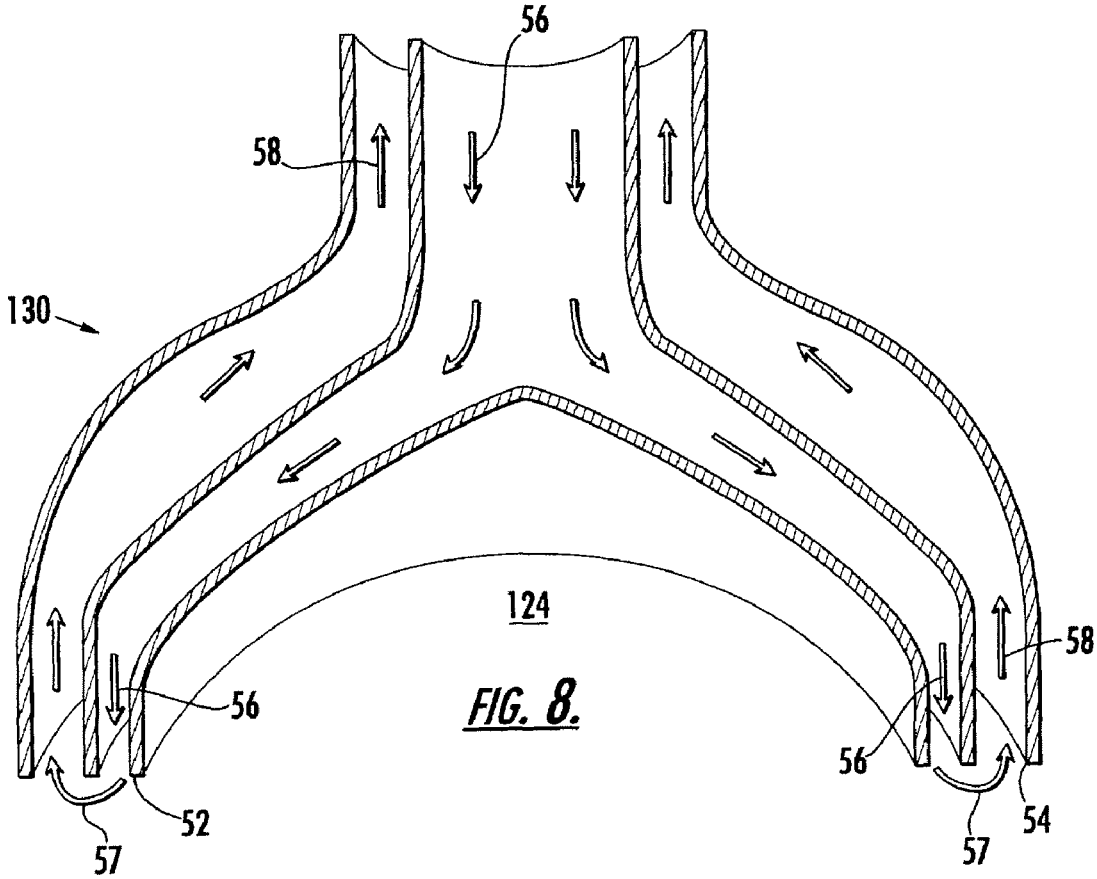
FIG. 8 is an enlarged view of the recirculating vacuum cleaning nozzle of FIG. 6.

FIGS. 7 and 8 show the vacuum nozzles of FIGS. 5 and 6, respectively, in greater detail. It should be understood that the vacuum nozzles could be utilized with any of the vacuum units of FIGS. 1-4.

Figure 7A:
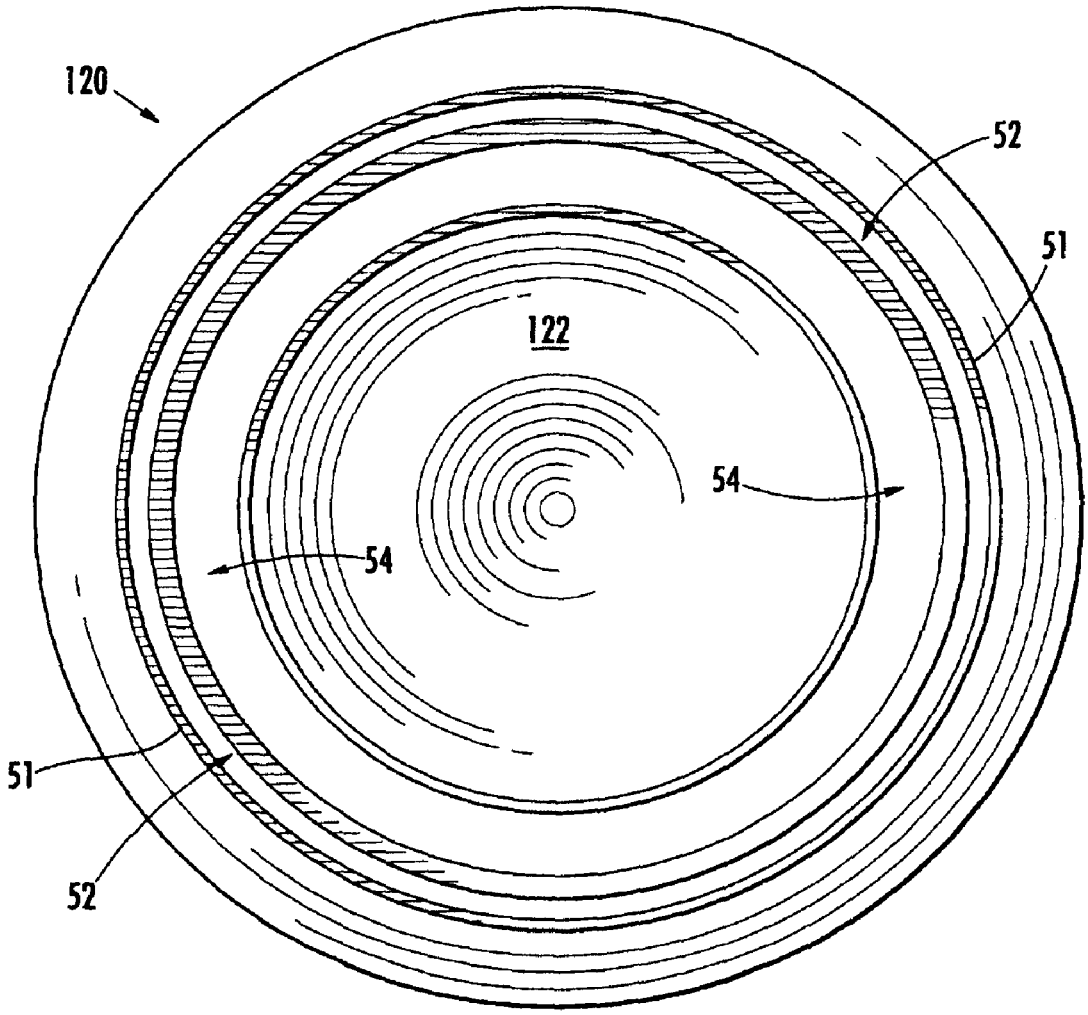
FIG. 7A is a bottom view of the recirculating vacuum cleaning nozzle of FIG. 7 showing a circular embodiment.

As shown in FIG. 7A, vacuum nozzle 120 includes exhaust port 52 that is generally circular in shape and surrounds suction port 54. Central void 122 is inward of suction port 54. It should be understood that the bottom view of FIG. 7A may not show the exact dimensional relationship between section port 54 and exhaust port 52 since the "width" of each port, as measured and recited herein, is measured generally perpendicular to the direction of flow of air through the port, for example, as shown in FIG. 7 by arrows 56 adjacent void 116.

Additionally, the extension of an outermost panel edge 51 beyond the other panels that form exhaust port 54 will cause a drawing such as FIG. 7A to show a variant relationship of exhaust and suction port widths.

Figure 9:
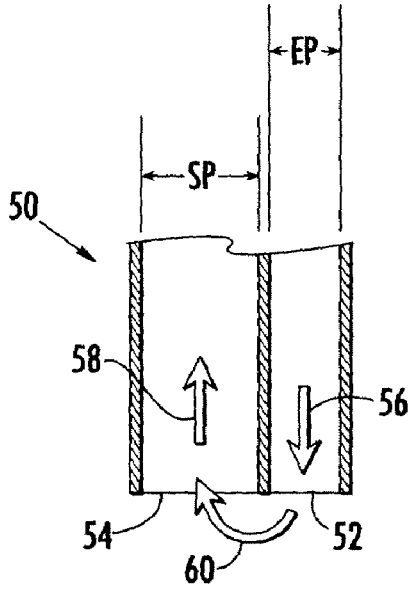
FIG. 9 is an enlarged diagrammatic sectional view of a recirculating vacuum nozzle in accordance with an embodiment of the present invention.

Referring to FIG. 9, a recirculating vacuum nozzle 50 is illustrated. Vacuum nozzle 50 has an exhaust port 52 and a suction port 54. The direction of air flow within ports 52 and 54 is shown by arrows 56 and 58, respectively. Arrow 60 illustrates that, when the synergistic concept of the present invention is initiated, air passing out of exhaust port 52 returns immediately to suction port 54. In one embodiment, exhaust port 52 and suction port 54 each define a generally rectangular cross-section of approximately six inches in length, and the exhaust port (EP) defines a width of about one-eighth of an inch (0.125 inches) and the suction port (SP) defines a width of about one-half of an inch (0.50 inches).

Figure 10:
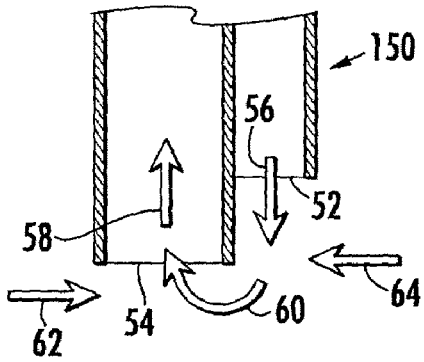
FIG. 10 is an enlarged diagrammatic sectional view of a recirculating vacuum nozzle in accordance with an embodiment of the present invention.

In general, the exhaust port will have a smaller width than the suction port and that it be offset at least slightly behind the suction line (see FIG. 10). However, as will become apparent from the disclosure below, the widths and respective configurations of the exhaust and suction lines can be varied to accommodate the particular end use of the floor cleaning device. For example, if the increased suction characteristic (or concept) of the present invention is already in effect, then the exhaust line can extend at least slightly forward of the suction line, particularly when the two lines or ports are adjacent to a floor or other surface.

Referring now to FIG. 10, another recirculating vacuum nozzle 150 having an exhaust port 52 offset behind suction port 54 is illustrated. In one embodiment, exhaust port 52 is offset behind suction port 54 by one-quarter inch (0.25 inches), and each port 52 and 54 defines a generally rectangular cross-section having widths of approximately one-eighth (0.125 inches) and one-half an inch (0.50 inches), respectively. By locating the exhaust port slightly behind the suction port in this manner, the synergistic effect of the present invention is initiated without need of placing the vacuum nozzle immediately adjacent to the floor or other cleaning surface. In the embodiments illustrated in FIGS. 9 and 10, when the vacuum nozzle is placed close to the surface of the floor, air is sucked into suction port 54 from both sides of the vacuum nozzle as shown at arrows 62 and 64.

In another embodiment, exhaust port 52 may define a smaller width, for example approximately one-sixteenth of an inch (0.0625 inches) for use in removing dirt from hardwood floors, linoleum coverings, or other smooth surfaces. By decreasing the width of exhaust port 52 and by also offsetting it further in back of suction port 54, for example to approximately three-eighths of an inch (0.375 inches) behind the suction port, it is possible to remove dirt from smooth surfaces while minimizing or even eliminating blowing dirt away from the suction port. In some devices, an exhaust air purge port may be employed to direct a portion of the exhaust air so that the vacuum nozzle doesn't blow debris, for example on a hardwood floor, away as the nozzle approaches the cleaning surface. As should be understood in this, any number of mechanisms could be employed for this purpose, for example, a hinged exhaust panel or sliding filter door cover or the like. By controlling the width of the opening, the operator can control the amount of purged air from the exhaust line.

Figure 11:
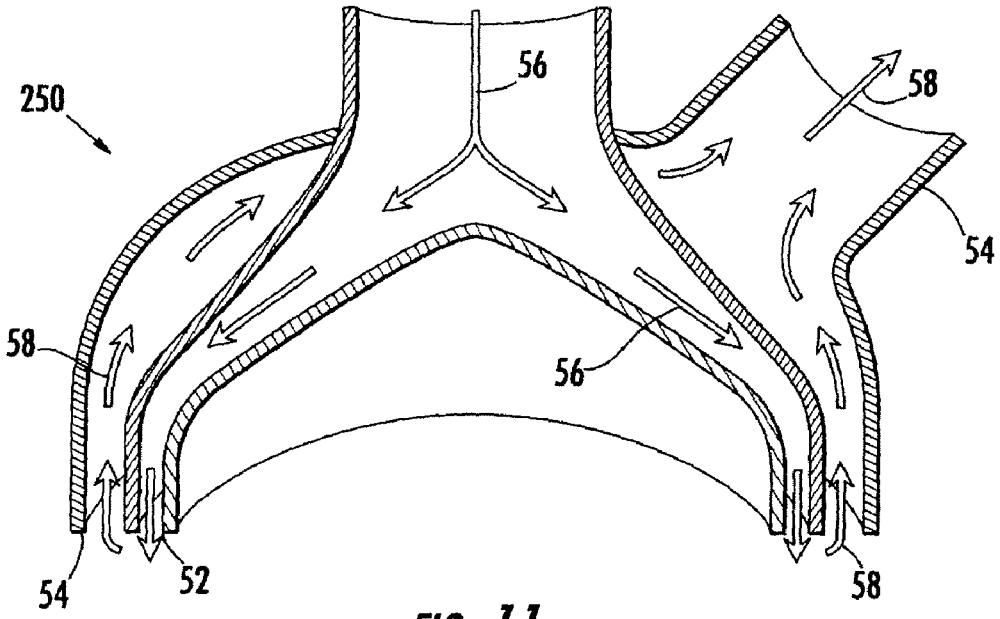
FIG. 11 is an enlarged diagrammatic sectional view of a recirculating vacuum cleaning nozzle in accordance with an embodiment of the present invention.

As shown in FIG. 11, another embodiment of a vacuum nozzle 250 in accordance with the present invention is illustrated. Vacuum nozzle 250 preferably forms a circular cross-section above the floor surface, but could be oblong, elliptical, or otherwise shaped. Vacuum nozzle 250 includes an exhaust port 52 and a suction port 54. Air flow in exhaust port 52 is shown by arrows 56, and air flow in suction port 54 is shown by arrows 58. In one embodiment, exhaust port 52 defines a gap width of approximately one-eighth of an inch (0.125 inch) and suction port 54 has a width of approximately one-half an inch (0.50 inch). Nozzle 250 of FIG. 11 closely resembles the nozzle of FIGS. 6 and 8, however, suction outlet 54 is separated from exhaust line 52 to facilitate connection with a dual hose vacuum as shown in FIG. 2.

It should be understood that the vacuum nozzles illustrated above and below could be incorporated into either an upright type vacuum cleaner (FIGS. 1, 3, and 4) or in a hand-held cleaning device (FIGS. 5 and 6) for use on furniture, walls, curtains, clothing and other surfaces. Additionally, a hand-held embodiment could be attached to the vacuum unit of FIG. 2 to exhaust and suction hoses extending from the recirculating unit. When the vacuum nozzles of the present invention are incorporated into an upright floor cleaning device as shown in FIGS. 1, 3, and 4, the distance from the exhaust and suction ports to the surface being cleaned may be varied to accommodate and facilitate use of the device on various floor coverings, for example on hardwood floors, short carpet, or shag carpet. In one embodiment, the distance from the suction line to the floor is approximately one-sixteenth of an inch (0.0625 inch).

It is also possible to provide an upright vacuum cleaner with adjustable wheels or other adjustment mechanisms, to allow the user to control the distance of the nozzle from the floor surface.

Referring now to FIG. 12, another embodiment of a vacuum nozzle 350 in accordance with the present invention is illustrated. Vacuum nozzle 350 includes exhaust port 52 and suction port 54, and air flow in each respective port is shown by arrows 56 and 58. Exhaust port 52 defines a first side panel 68 having a forward end 70. Exhaust port 52 is also bounded on its opposite side by a middle panel 72 defining a forward end 74 that is recessed behind first side panel forward end 70. Suction port 54 is defined by a second side panel 76 having a forward end 78 that extends ahead of first side panel forward end 70. The concept of the present invention is shown by arrow 62, as air is sucked into the suction port from an area outside second side panel forward end 78 and arrow 60 shows how exhaust air immediately returns to the suction port 54.

FIG. 13 illustrates the effect of the increased suction created by vacuum nozzle 150 when utilized on a carpet floor covering. As shown by arrow 62, air is sucked up from side B, but not from side A. Additionally, the air exhausted from outlet port 52 vibrates carpet fibers 80 and penetrates to the base ends of fibers 80 to a carpet web 82 to enhance the debris removal and carpet drying capabilities of the device.

Referring now to FIG. 14, vacuum nozzle 50 is illustrated above a carpet surface. As shown by arrow 60, air from exhaust port 52 vibrates carpet fibers 80 and is sucked into suction port 54, thus utilizing the synergy between the exhaust and suction lines not only to increase the suction as described above, but also to assist in dislodging and removing dirt, debris and moisture.

Figure 15:
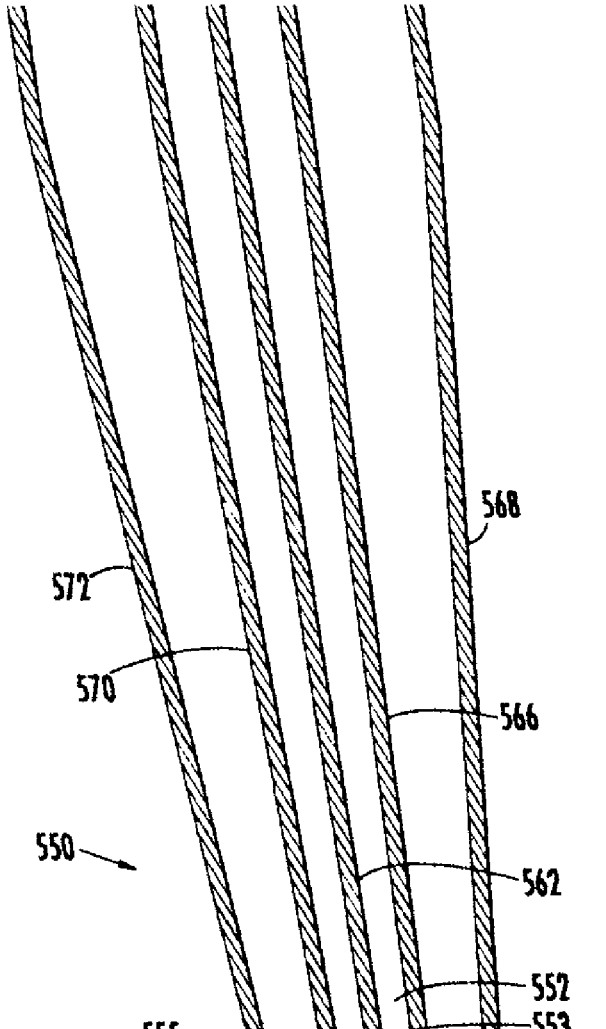
FIG. 15 is an enlarged diagrammatic sectional view of a recirculating vacuum nozzle in accordance with an embodiment of the present invention.
Figure 16:
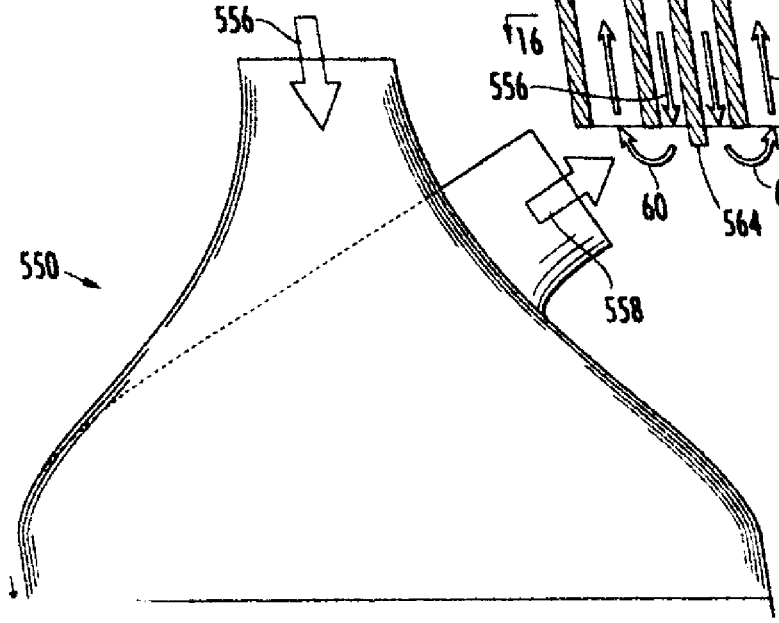
FIG. 16 is a front view of the vacuum nozzle of FIG. 15.

FIGS. 15 and 16 illustrate other embodiments of a vacuum nozzle 550 in accordance with an embodiment of the present invention. Vacuum nozzle 550 includes two adjacent interior exhaust ports 552 and 553 separated from each other by a center panel 562. Exhaust port 552 is adjacent to a suction port 554 and the two are separated by a first right side panel 566, which together with a second right side panel 568 forms suction port 554. Exhaust port 553 is adjacent to a suction port 555 and the two are separated by a first left side panel 570, which together with a second left side panel 572 forms suction port 555.

Center panel 562 defines a forward end 564 that extends beyond the forward ends of adjacent panels in one embodiment by a distance (DC) of approximately one-eighth of an inch (0.125 inch). Vacuum nozzle 550 can be mounted in a floor cleaning device so that the center panel forward end 564 contacts the carpet fibers to enhance the debris removal function. The suction and exhaust ports are preferably of a generally rectangular cross-section and define widths of approximately one-half inch (0.50 inch) and one-eighth of an inch (0.125 inch) respectively, as in the previous embodiments. Exhausted airflow is shown at arrows 556 and suction airflow is shown at arrows 558.

As shown in FIG. 16, vacuum nozzle 550 in one embodiment is approximately twelve (12) inches across as marked, and center panel forward end 564 extends ahead of the forward ends of the adjacent panels by distance DC. Exhaust airflow is shown at arrow 556 and suction airflow is shown at arrow 558.

Figure 16A:
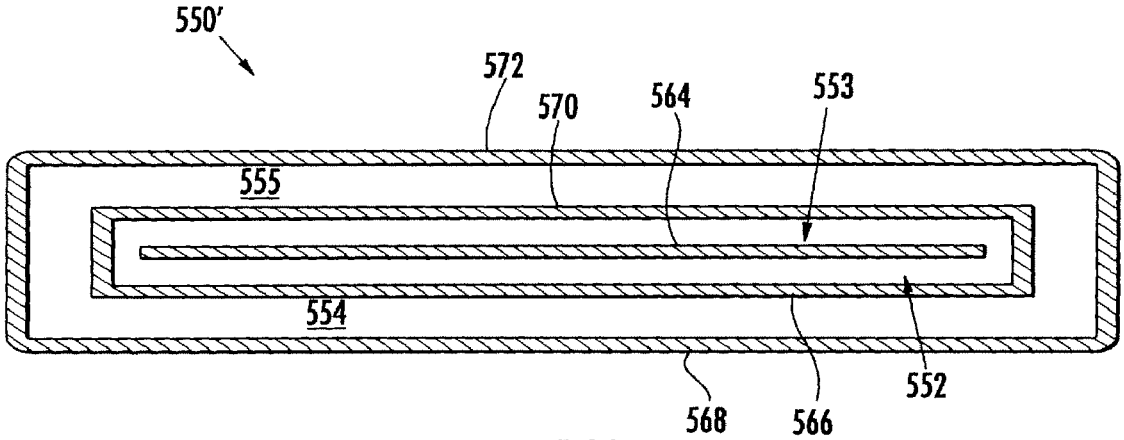
FIG. 16A is a cross-sectional view taken along line 16-16 of FIG. 15.
Figure 16B:
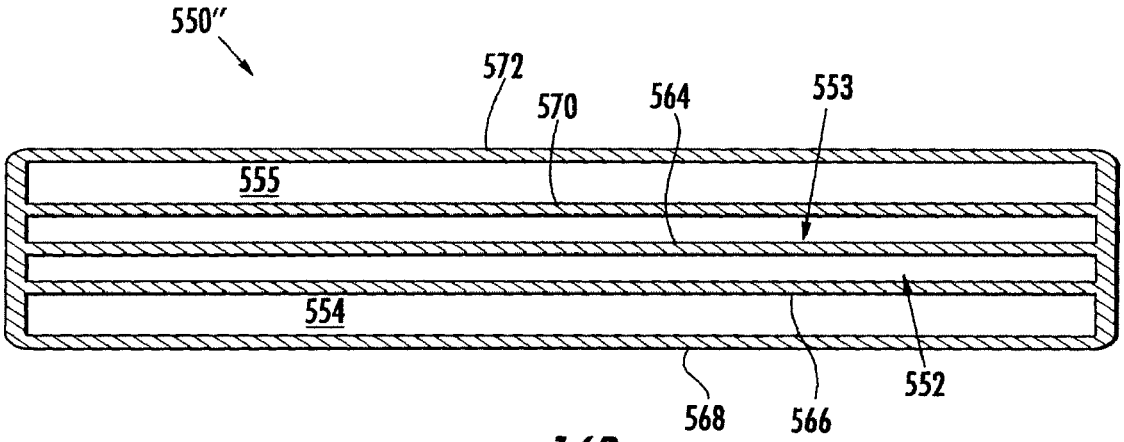
FIG. 16B is a cross-sectional view similar to FIG. 16A of an alternative embodiment.

As shown in FIG. 16A and 16B, vacuum nozzle 550 may be configured several different ways. For example, vacuum nozzle 550' of FIG. 16A shows that suction ports 554 and 555 may join at opposite ends to surround exhaust ports 552 and 553, which may also join at opposite ends. In vacuum nozzle 550" of FIG. 16B, each port 552, 553, 554, and 555 defines a generally rectangular cross-section. It should be understood that FIGS. 17-23 could be designed in various other ways in addition to the designs of FIGS. 16A and 16B.

Figure 17:
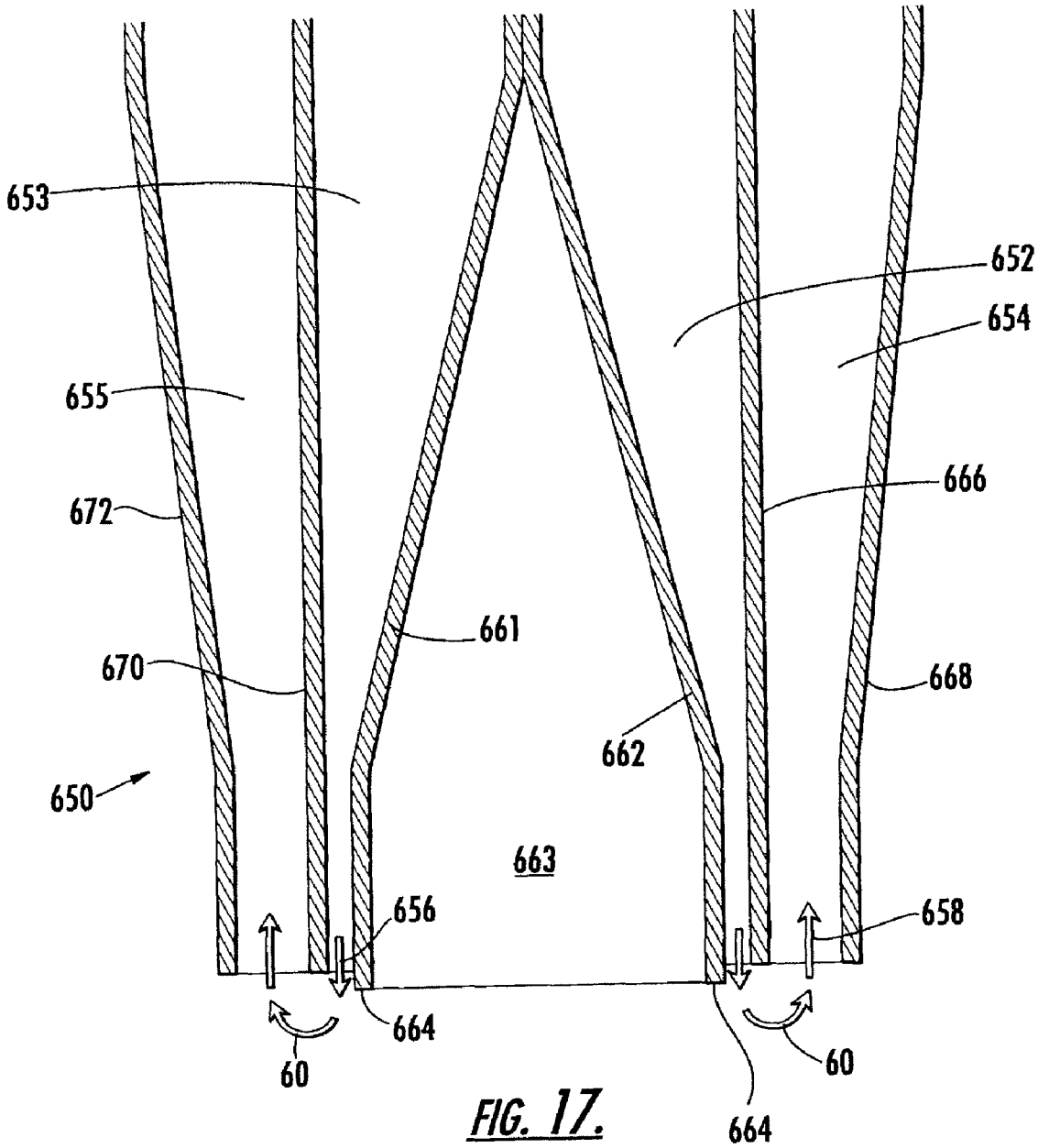
FIG. 17 is an enlarged diagrammatic sectional view of a recirculating vacuum nozzle in accordance with an embodiment of the present invention.

FIG. 17 illustrates another embodiment of a vacuum nozzle 650 in accordance with an embodiment of the present invention. Vacuum nozzle 650 includes two adjacent interior exhaust ports 652 and 653 separated from each other by a central cavity 663. Exhaust port 652 is adjacent to a suction port 654 and the two are separated by a first right side panel 666, which together with a second right side panel 668 forms suction port 654. Exhaust port 653 is adjacent to a suction port 655 and the two are separated by a first left side panel 670, which together with a second left side panel 672 forms suction port 655. Exhaust air from ports 652 and 653 is immediately sucked into suction ports 654 and 655 as shown by arrow 60.

Central cavity 663 is defined by a pair of center panels 661 and 662, each defining a forward end 664 of the vacuum nozzle that extends beyond the forward ends of panels 666, 668, 670, and 672. In one embodiment, forward end 664 extends ahead of these panels by a distance of one-eighth of an inch (0.125 inch). Vacuum nozzle 650 can be formed such that the suction and exhaust ports are of a generally rectangular cross-section and define widths of one-half inch (0.50 inch) and one-eighth of an inch (0.125 inch) respectively, as in the previous embodiments, or it could include other configurations, for example an oblong, elliptical, or circular configuration.

Figure 18:
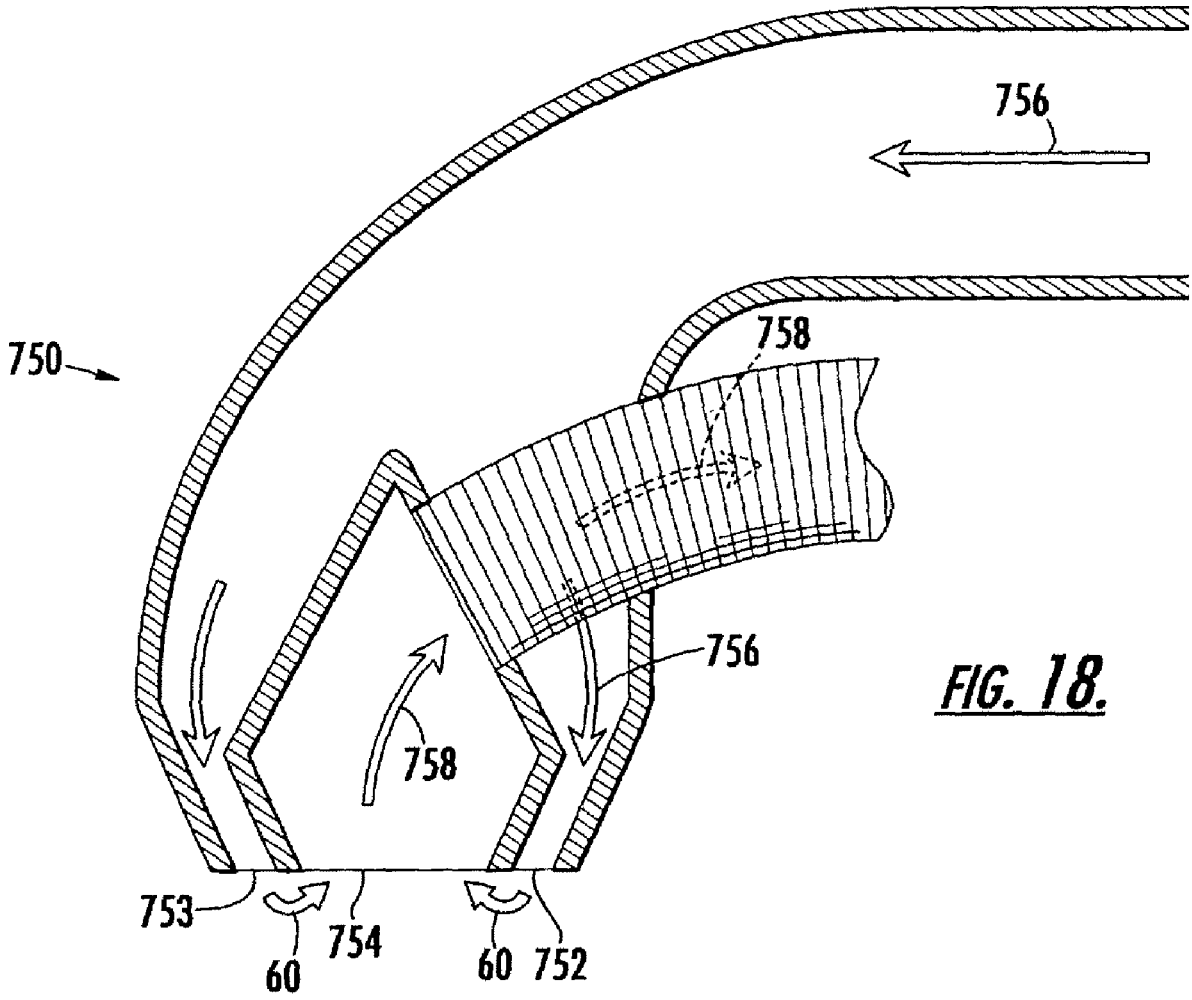
FIG. 18 is an enlarged diagrammatic sectional view of a recirculating vacuum nozzle in accordance with an embodiment of the present invention.

FIG. 18 illustrates another embodiment of a vacuum nozzle 750 in accordance with an embodiment of the present invention. Vacuum nozzle 750 includes two outward exhaust ports 752 and 753 separated from each other by a central suction port 754. Central suction port 754, in this embodiment is approximately one inch wide and the exhaust ports are one-eighth of an inch in width (0.125 inch). Vacuum nozzle 750 can be formed such that the suction and exhaust ports each form a generally oblong, elliptical, or circular configuration. Exhausted air flow is shown at arrows 756 and suction air flow is shown at arrows 758.

Figure 19:
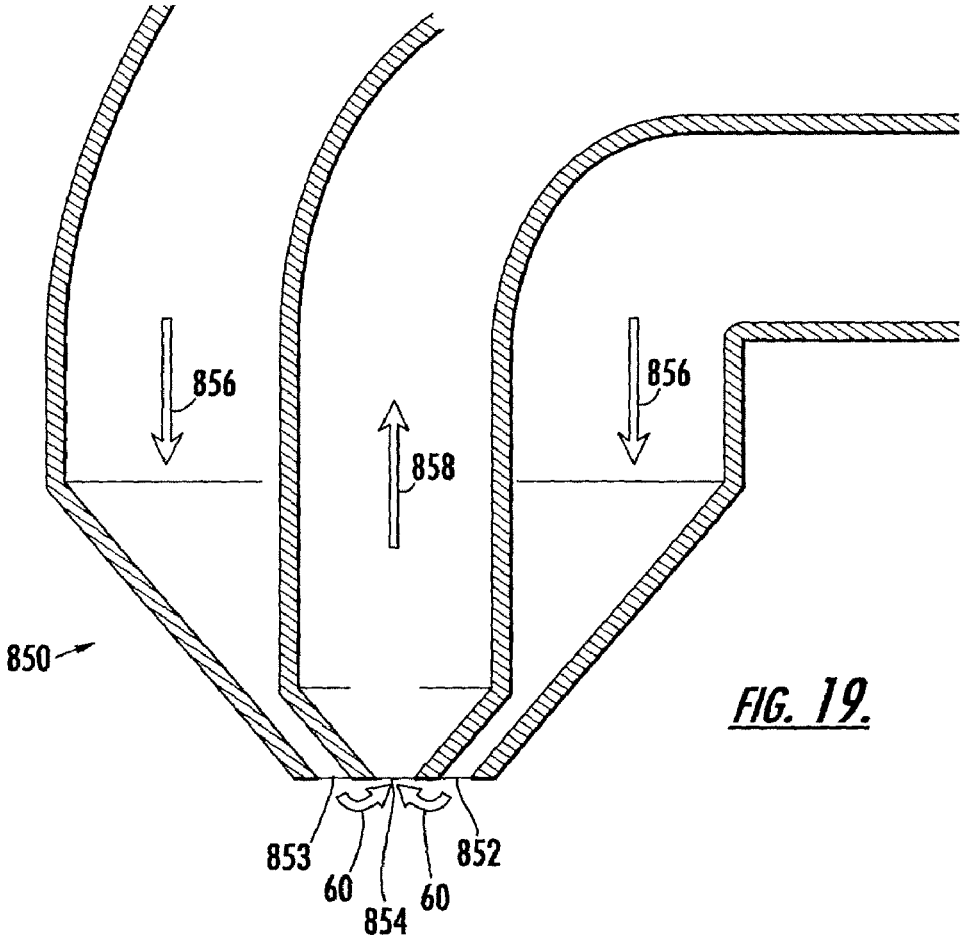
FIG. 19 is an enlarged diagrammatic sectional view of a recirculating vacuum nozzle in accordance with an embodiment of the present invention.

FIG. 19 illustrates another embodiment of a vacuum nozzle 850 in accordance with an embodiment of the present invention. Vacuum nozzle 850 includes two outward exhaust ports 852 and 853 separated from each other by a central suction port 854. Central suction port 854, in this embodiment is approximately one-half inch wide and exhaust ports 852 and 853 are one-eighth of an inch (0.125 inch). Vacuum nozzle 850 can be formed such that the suction and exhaust ports each form a generally oblong, elliptical, or circular construction. The angle of inclination of exhaust ports 852 and 853 with respect to a vertical plane that passes through arrow 858 is preferably approximately 45 degrees, whereas the same angle measured on vacuum nozzle 750 (FIG. 18) for ports 752 and 753 is preferably approximately 35 degrees. However, it should be understood that numerous configurations (including varying widths, angles, and other criteria related to the suction and exhaust ports) may be utilized in a vacuum nozzle within the scope and spirit of the present invention. Exhausted air flow is shown at arrows 856 and suction air flow is shown at arrow 858.

Figure 20:
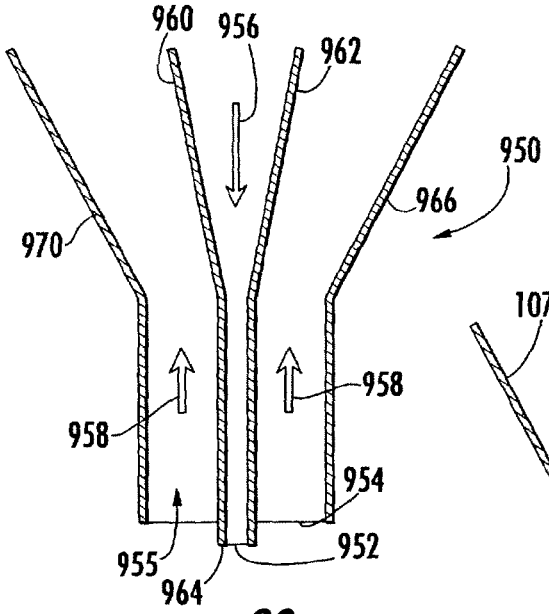
FIG. 20 is an enlarged diagrammatic view of a recirculating vacuum nozzle in accordance with an embodiment of the present invention.

FIG. 20 illustrates another embodiment of a vacuum nozzle 950 in accordance with an embodiment of the present invention. Vacuum nozzle 950 includes two exterior suction ports 954 and 955 separated from each other by a central exhaust port 952. Exhaust port 952 is defined by a pair of interior panels 960 and 962. Interior panel 962, together with a right side panel 966 forms right side suction port 954. Interior panel 960, together with a left side panel 970 forms left side suction port 955. A forward end 964 of interior panels 960 and 962 extends forward of respective forward ends of outer panels 966 and 970. Vacuum nozzle 950 can be mounted in a floor cleaning device so that the middle panel forward end 964 contacts the carpet fibers to enhance the debris removal function. The suction and exhaust ports are preferably of a generally rectangular cross-section and define widths of approximately one-half inch (0.50 inch) and one-eighth of an inch (0.125 inch) respectively, as in some previous embodiments. Exhausted airflow is shown at arrow 956 and suction airflow is shown at arrows 958.

Figure 21:
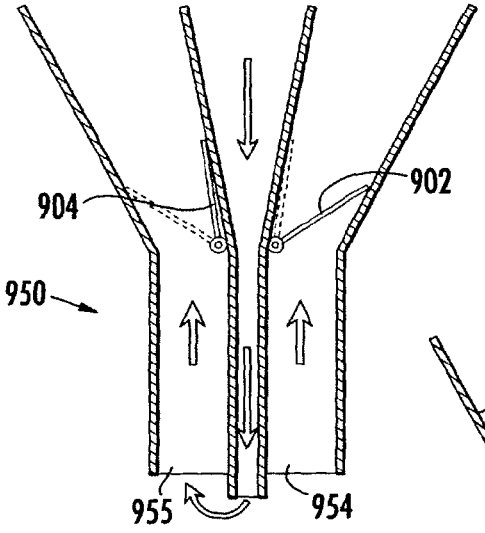

FIG. 21 illustrates vacuum nozzle 950 with gate valves 902 and 904 defined respectively in suction ports 954 and 955.

Gate valves 902 and 904 operate to ensure that only one suction port is open at one time and are preferably configured so that the suction port defmed on the side of the exhaust port in the direction of travel is open. For example, when vacuum nozzle moves from right to left in FIG. 21, gate valve 904 may be open as shown. When the direction is reversed, gate valve 904 closes and gate valve 902 opens to allow suction air to pass through suction port 954. Preferably, these gate valves work together so that when one is closed the other is open. The opening and closing of gate valves 902 and 904 is controlled by any suitable method, for example by the direction of rolling of supporting wheels (FIG. 3), by an electrically controlled solenoid valve actuated by electric current from an accelerometer or by other known mechanisms for determining direction of travel.

Figure 22:
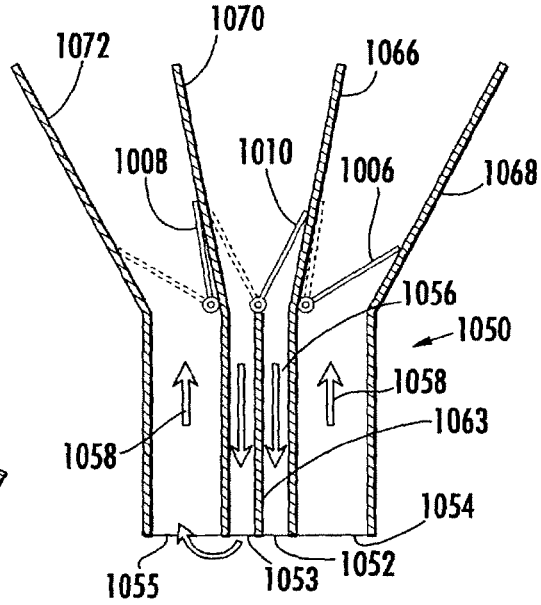
FIGS. 21-23 are enlarged diagrammatic views of recirculating vacuum nozzles having valve closures in accordance with other embodiments of the present invention.

FIG. 22 illustrates another embodiment of a vacuum nozzle 1050 in accordance with an embodiment of the present invention. Vacuum nozzle 1050 includes two adjacent interior exhaust ports 1052 and 1053 separated from each other by a central wall panel 1063. Right side exhaust port 1052 is adjacent to a suction port 1054 and the two are separated by a first right side panel 1066, which together with a second right side panel 1068 forms suction port 1054. Left side exhaust port 1053 is adjacent to a suction port 1055 and the two are separated by a first left side panel 1070, which together with a second left side panel 1072 forms suction port 1055.

Central panel 1063 may extend beyond panels 1066, 1068, 1070, and 1072 at its forward end. Vacuum nozzle 1050 can be formed such that the suction and exhaust ports are of a generally rectangular cross-section and define widths of approximately one-half inch (0.50 inch) and one-eighth of an inch (0.125 inch) respectively, as in the previous embodiments, or it could include other configurations. Gate valves 1006 and 1008 are defined respectively in suction ports 1054 and 1055 and are preferably configured so that when one is open, the other is closed. A third gate valve 1010 is hinged to an upper portion of central panel 1063 and operates in conjunction with gate valves 1006 and 1008 to ensure that the exhaust port is open when the adjacent suction port is open and closed when the adjacent suction port is closed. Preferably, the forward-most suction and exhaust ports are open as the device moves across a surface, for example ports 1053 and 1055 are open as nozzle 1050 moves from right to left. When this direction reverses, these ports close and ports 1052 and 1054 open.

Figure 23:
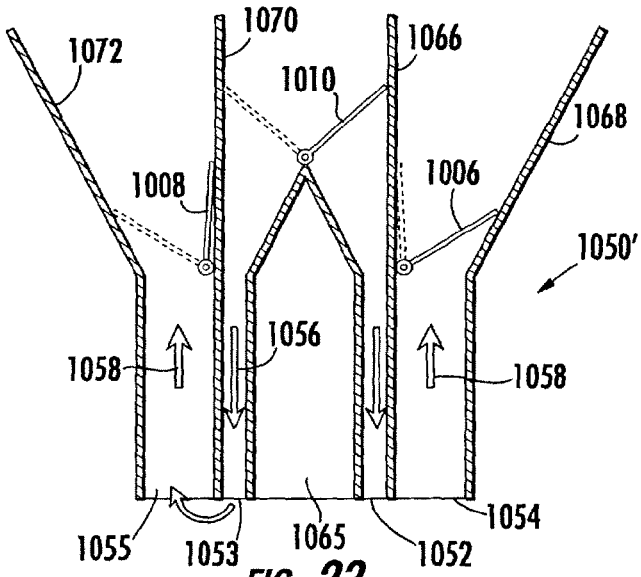

FIG. 23 illustrates an alternative embodiment of vacuum nozzle 1050' in which central panel 1063 is replaced with a central cavity 1065 similar to that of FIG. 17. Vacuum nozzle 1050' can be formed such that the suction and exhaust ports are of a generally rectangular cross-section and define widths of approximately one-half inch (0.50 inch) and one-eighth of an inch (0.125 inch) respectively, as in the previous embodiments, or it could include other configurations, for example an oblong, elliptical, or circular construction.

It should be understood that various other types of gates or closure mechanisms could be employed to control the flow of air within the suction and exhaust lines, and further that the gates could open in either direction. For example, gate valves 904 and 902 of FIG. 21 could open and close such that the rotating end of the gate is directed toward the nozzle end of the device.

Figure 35:
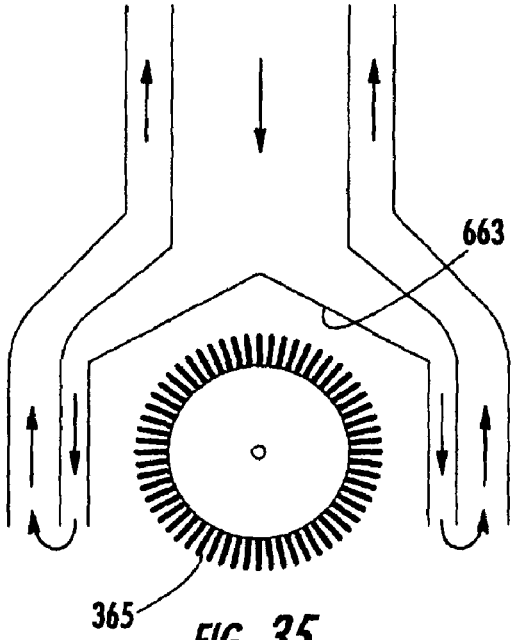
FIGS. 35 is an enlarged diagrammatic sectional view of a recirculating vacuum and a roller brush in accordance with an embodiment of the present invention.
Figure 36:
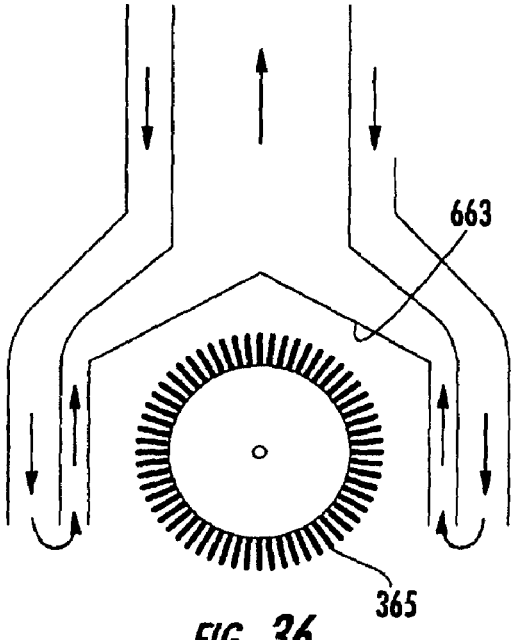
FIG. 36 is an enlarged diagrammatic sectional view of a recirculating vacuum and a roller brush in accordance with another embodiment of the present invention.

Referring also to FIGS. 35 and 36, it should be understood that a roller brush 365 could be employed with the present invention, particularly in the nozzles disclosed in FIGS. 17-19, and/or with the nozzle of FIG. 23. For example, as should be clearly understood from FIGS. 35 and 36, roller brush 365 (when used with the device of FIG. 17) would be located in void space 663. In the nozzle device of FIGS. 18 and 19, the roller brush would be located in the suction port, and in the nozzle of FIG. 23, it would be in void space 1065.

Figure 37:
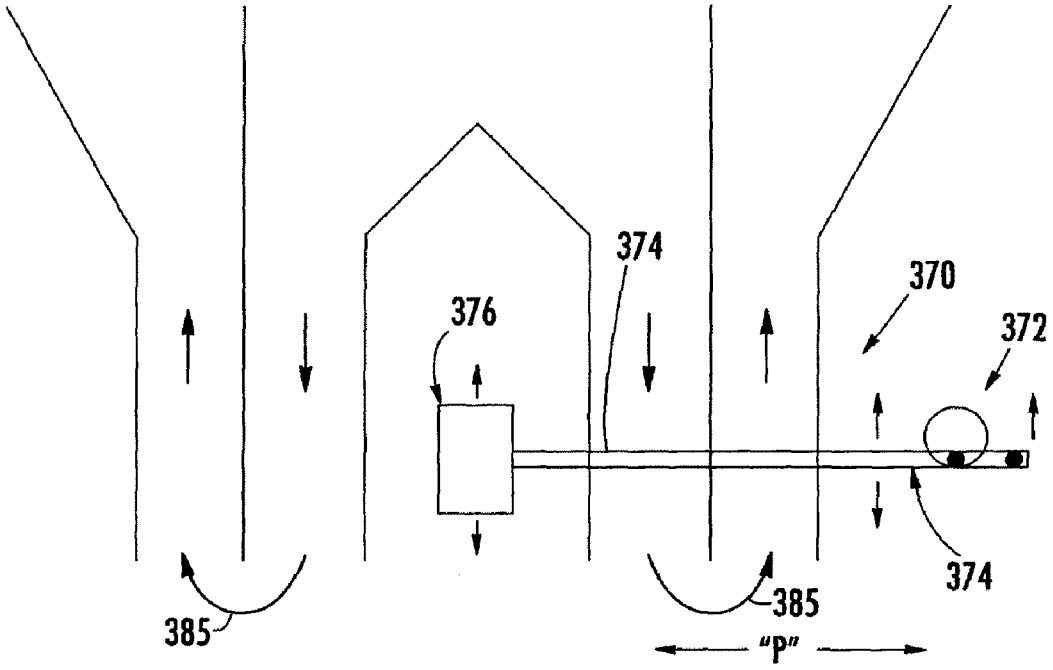
FIG. 37 is an enlarged diagrammatic sectional view of a recirculating vacuum and a vibration creating device in accordance with an embodiment of the present invention.

Referring also to FIG. 37, a vibration mechanism 370 is illustrated in which a cam 372 rotates to move a lever arm 374 and hammer end 376 up and down to create vibration within the vacuum housing. As should be understood, air flow through the exhaust and suction nozzles of the illustrated embodiment is shown by arrows 385. The vibration or added energy increases the vibration of the carpet fibers, thus dislodging more debris and taking in even more moisture. It should be understood that, if employed, various pivot locations "P" could be utilized within the scope of the present invention, as well as varying cam sizes to control the amount of movement of the lever arm and hammer end within the vacuum housing. The hammer end may or may not contact the cleaning surface, and may be adjustable so that, for example it could firmly tap a carpeted surface, but avoid contact with a hardwood floor surface, or vice versa. The hammer end could be covered with an elastomeric or other soft surface (not shown) to prevent damage to a cleaning surface should contact occur. In one embodiment, the hammer end moves vertically approximately one inch with respect to the vacuum housing. Additionally, it should be understood that vibration mechanism 370 could be employed with other types of vacuum nozzle configurations.

It should be understood that cam 372 could cause horizontal or other directional movement of the lever arm and hammer end with respect to the vacuum housing to create vibration within the housing. Additionally, other vibration sources could be used within the scope and spirit of the present invention, for example a vibrating motor similar to that found within a hand-held therapeutic massage device or other similar device. Known mechanisms may be employed to maintain and enhance the vacuum housing structure to accommodate the added vibration, for example lock and/or elastomeric washers or the like.

Figure 24:
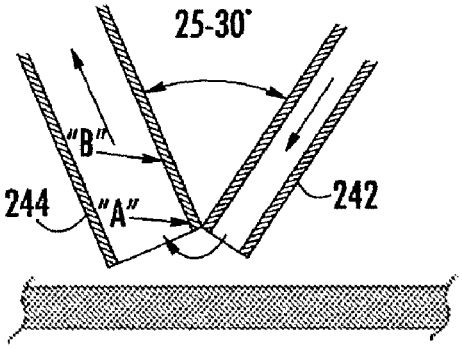
FIG. 24 is an enlarged diagrammatic sectional view of a recirculating vacuum nozzle in accordance with an embodiment of the present invention.

FIG. 24 illustrates an angled embodiment of the present invention (having a dimensional configuration similar to that of the nozzle illustrated in FIG. 9). In this embodiment, an exhaust line or port 242 and suction line or port 244 are angled approximately 25-30 degrees with respect to each other. The combination of reflected exhaust air from the right side exhaust stream and the angled configuration results in very powerful overall suction and a minimum amount, if any, of exhaust air being blown away from the suction port.

Figure 25:
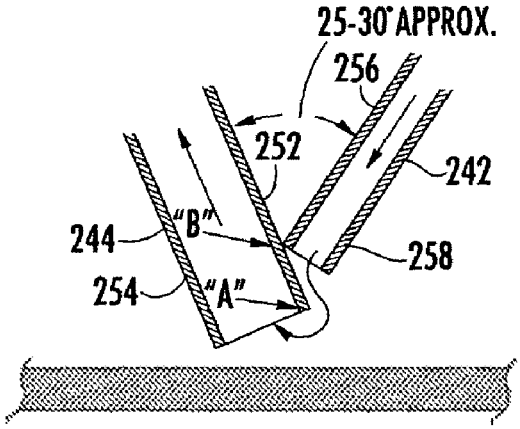
FIG. 25 is an enlarged diagrammatic sectional view of a recirculating vacuum nozzle in accordance with another embodiment of the present invention.

FIG. 25 illustrates the nozzle of FIG. 24 where the forward end of the exhaust port is moved from location "A" to a location "B." In some embodiments, location "B" may be approximately one-half inch (0.50 inches) up from the interior end of the suction port. This configuration increases the turbulence in the exhaust airflow and thus increases the vibration within the housing that translates through the structure to the cleaning surface and carpet fibers, which enhances removal of debris and/or moisture.

As shown, suction port 244 is at least partially defined by an inner panel 252 and an outer panel 254. Exhaust port 242 is at least partially defined by an inner panel 256 and an outer panel 258. A forward end of exhaust port inner panel 256 is disposed adjacent to and may come into contact with an outer surface of suction port 244 at suction port inner panel 252. As should be understood, in an embodiment having generally rectangularly shaped ports, side ports form the remainder of the suction and exhaust ports, including the inner and outer surfaces of these ports.

Figure 26:
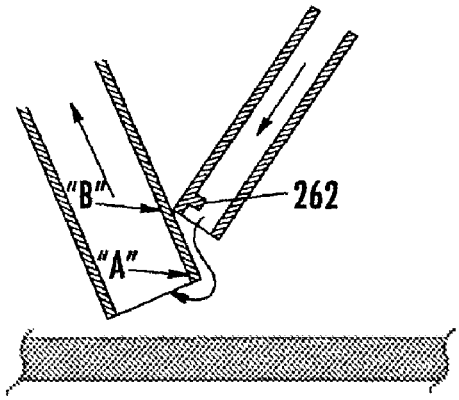
FIGS. 26-28 illustrate various embodiments of the vacuum nozzle of FIG. 25.

FIG. 26 illustrates the nozzle of FIG. 25 with a ridge or baffle 262 added to the exhaust port to further increase turbulence in the exhaust airflow and thus vibration of the carpet fibers beneath the nozzle.

Figure 27:
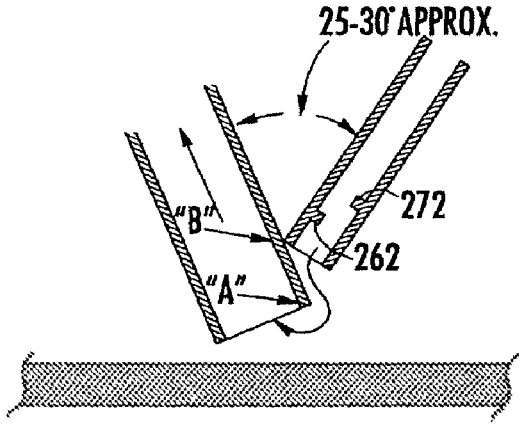

FIG. 27 illustrates the nozzle of FIG. 25 with a first ridge 262 and a second ridge 272 positioned at varying axial locations within the exhaust port to create turbulence and vibration within the vacuum housing.

Figure 28:
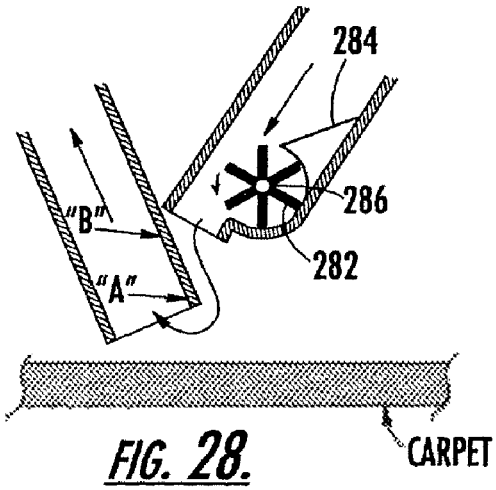

FIG. 28 illustrates the nozzle of FIG. 25 having a paddle wheel 282 and an angled baffle 284 to create turbulence in the exhaust air flow and resultant vibration in the carpet fibers. As shown, paddle wheel 282 is rotatable about a paddle axis 286. Although various mechanisms do enhance and/or modify the vibration of carpet fibers or other cleaning surfaces, it should be understood that the "concept" of the present invention itself causes vibration without the inclusion of the various vibration assistance mechanisms.

Figure 39:
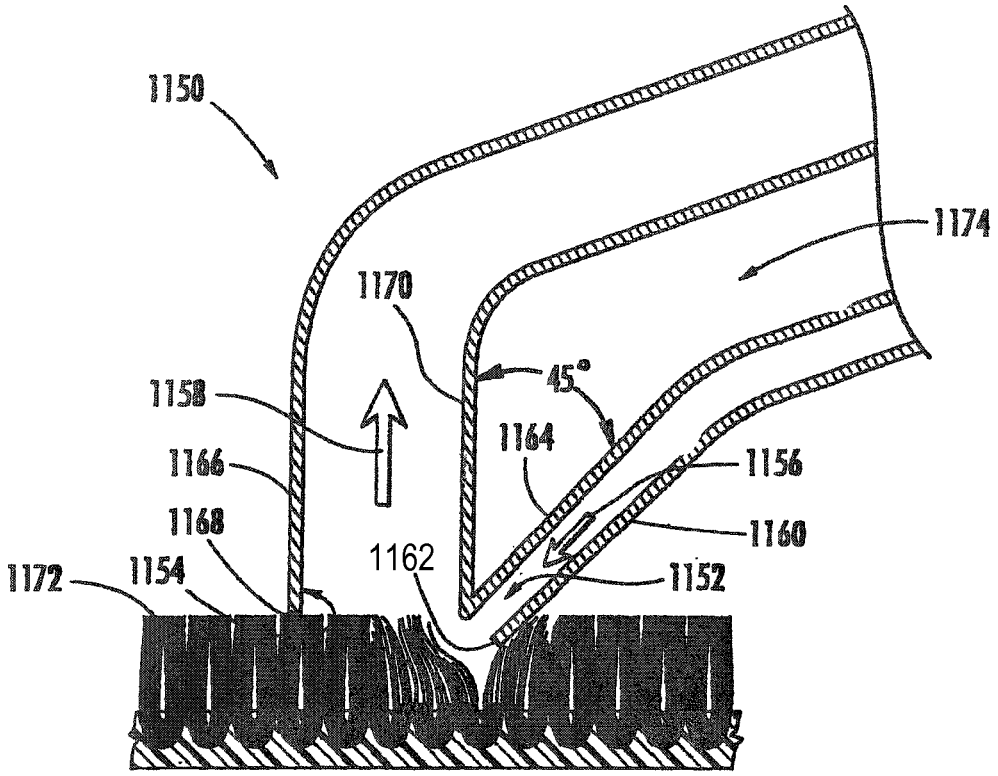
FIG. 39 is a side view of a vacuum nozzle which could be used with the present invention.

Referring now to FIG. 39, another embodiment of a vacuum nozzle in accordance with the present invention is illustrated. Vacuum nozzle 1150 includes an exhaust port 1152 and a suction port 1154. Arrows 1156 and 1158 show the path of airflow in exhaust port 1152 and suction port 1154, respectively. Exhaust port 1152 is defined by a first panel 1160 having a distal end 1162 and a second panel 1164. Suction port 1154 is defined by a first panel 1166 having a distal end 1168 and a second panel 1170. In one embodiment, exhaust port 1152 has a width of approximately three-sixteenth of an inch (0.1875 inches), and suction port 1154 has a width of approximately five-eighth of an inch (0.625 inches).

In the embodiment shown, suction port 1154 is recessed from exhaust port 1152, such that only exhaust port 1152 contacts the surface being cleaned 1172, which in the example shown is carpet. Preferably, distal end 1162 of exhaust port's first panel 1160 extends approximately three-sixteenth of an inch (0.1875 inches) beyond distal end 1168 of suction port's first panel 1166. This allows exhaust port 1152 to provide a mechanical agitating action to the surface being cleaned 1172. For example, exhaust port may aid in separating carpet fibers. Moreover, this configuration allows vacuum nozzle 1150 to travel along the surface to be cleaned 1172 with minimal effort.

In the embodiment shown, exhaust port 1152 is angled with respect to suction port 1154. This angled configuration may be produced at least in part by a void space 1174 defined between the two ports. In one embodiment, the angle between the two ports is approximately 45 degrees. Preferably, exhaust port 1152 is configured at an angle of approximately 45 degrees with respect to the surface being cleaned 1172 while suction port 1154 is approximately perpendicular to the surface being cleaned 1172.

Figure 40:
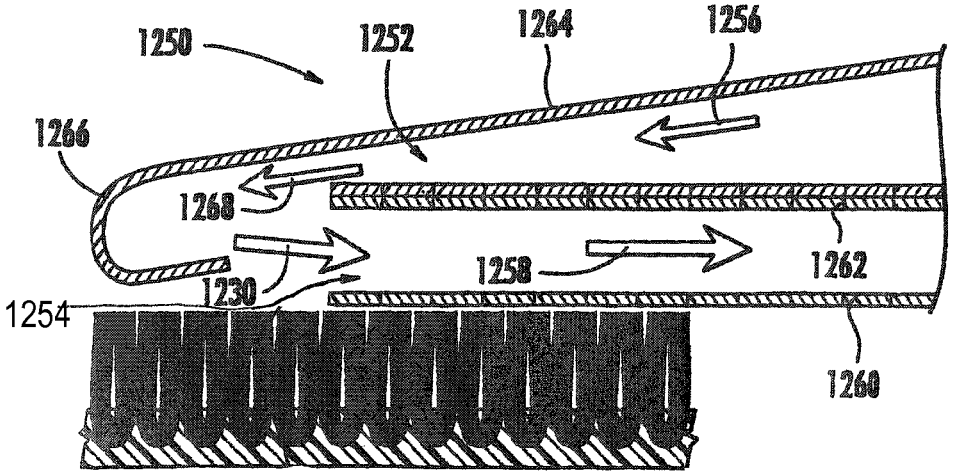
FIG. 40 is a side view of a vacuum nozzle which could be used with the present invention.

Referring now to FIG. 40, another embodiment of a vacuum nozzle 1250 in accordance with the present invention is illustrated. Vacuum nozzle 1250 includes an exhaust port 1252 and a suction port 1254. Arrows 1256 and 1258 show the path of airflow in exhaust port 1252 and suction port 1254, respectively. Suction port 1254 is defined by a first panel 1260 and a second panel 1262. Exhaust port 1252 is defined by second panel 1262 and a third panel 1264. In the embodiment shown, exhaust port 1252 and suction port 1252 share a common panel (i.e., second panel 1262), however, it should be appreciated that both ports 1252 and 1254 could have separate panels. In one embodiment, suction port 1254 has a width of approximately one-half of an inch (0.5 inches) and exhaust port 1252 has a decreasing dimension toward its exit which terminates with a width of approximately 3/32 of an inch (0.09375 inches).

As shown, third panel 1264 of exhaust port 1252 has an integral redirection member 1266 positioned in the path of fluid expelled from exhaust port (shown by arrow 1268) to reflect the expelled fluid into a desired direction (shown by arrow 1230). In one embodiment, redirection member 1266 is approximately 1.5 inches from the distal end of exhaust port 1252. It should be appreciated that redirection member 1266 need not be integrally formed in exhaust port 1252, but could be integrally formed in suction port 1254 or separately connected to either of the ports 1252 and 1254.

Preferably, redirection member 1266 is configured to reflect expelled fluid toward suction port 1254. For example, redirection member 1266 could be arcuate in shape with a curvature to reflect fluid toward suction port 1254. If the fluid expelled from exhaust port 1252 travels in a generally opposite direction from the fluid drawn into suction port 1254, the curvature of redirection member 1266 may be approximately 180 degrees.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

I claim:

1. A fluid recirculating cleaning device, said device comprising:

an exhaust port defining a flow path therethrough;

a suction port defining a flow path therethrough;

wherein said suction port terminates substantially co-planar with the exhaust port;

a vacuum blower motor operative to draw fluid into said suction port and expel fluid out of said exhaust port;

wherein fluid in said exhaust port travels in a generally opposite direction than fluid in said suction port;

a redirection member positioned in the path of fluid expelled from said exhaust port for reflecting expelled fluid toward said suction port; and said redirection member terminating at least a given distance from the termination of the suction port.

2. The fluid recirculating device as recited in claim 1, wherein said redirection member is positioned approximately 1.5 inches away from said suction port in the path of fluid expelled from said exhaust port and terminates prior to the plane of the exhaust port and suction port termination.

3. The fluid recirculating device as recited in claim 1, wherein said redirection member has an arcuate shape.

4. The fluid recirculating device as recited in claim 1, wherein said redirection member is configured to reflect fluid expelled from said exhaust port into a generally opposite direction.

5. The fluid recirculating device as recited in claim 1, wherein said exhaust port has a reduced dimension toward said redirection member.

6. The fluid recirculating device as recited in claim 1, wherein the cross-sectional area of said exhaust port and said suction port are generally rectangular.

7. The fluid recirculation device as recited in claim 6, wherein the cross-sectional area of said suction port is greater than the cross-sectional area of said exhaust port.

8. The fluid recirculation device as recited in claim 1, wherein said redirection member has a major dimension which is substantially coexistent with a major dimension of said exhaust port.

9. A fluid recirculating cleaning device, said device comprising:

an exhaust port defining a flow path therethrough, said exhaust port having a redirection portion proximate to the distal end of said flow path;

a suction port defming a flow path therethrough;

wherein said exhaust port and said suction port each terminate substainally co-planar;

a vacuum blower motor operative to draw fluid into said suction port and expel fluid out of said exhaust port;

said redirection member being configured to reflect fluid expelled from said exhaust port toward said suction port such that the reflected fluid agitates the surface to be cleaned; and said redirection member terminating at least a given distance from the termination of the suction port.

10. The fluid recirculating cleaning device as recited in claim 9, wherein said redirection member is curved about an axis approximately perpendicular to the path of fluid expelled from said exhaust port.

11. The fluid recirculating cleaning device as recited in claim 10, wherein said redirection member has approximately a 180 degree curvature.

12. The fluid recirculating cleaning device as recited in claim 9, wherein said flow path in said exhaust port is defined by an exhaust wall and a common wall and said flow path in said suction port is defined by a suction wall and said common wall.

13. The fluid recirculating cleaning device as recited in claim 12, wherein said suction wall rides on the surface to be cleaned.

14. The fluid recirculating cleaning device as recited in claim 12, wherein said redirection portion is integrally formed in said exhaust wall.

* * * * *